US011789385B2

(12) United States Patent
Aoki et al.

(10) Patent No.: US 11,789,385 B2
(45) Date of Patent: Oct. 17, 2023

(54) TRANSFER BIAS AND PRESSURE IN AN IMAGE FORMING APPARATUS

(71) Applicants: Yuuki Aoki, Tokyo (JP); Seiichi Kogure, Kanagawa (JP); Hideki Kimura, Kanagawa (JP); Hiroshi Kikuchi, Kanagawa (JP); Yutaka Takahashi, Kanagawa (JP); Yusuke Ishizuka, Kanagawa (JP); Takuya Akiyama, Kanagawa (JP); Yutaka Goto, Kanagawa (JP); Kazuhiro Shimada, Kanagawa (JP)

(72) Inventors: Yuuki Aoki, Tokyo (JP); Seiichi Kogure, Kanagawa (JP); Hideki Kimura, Kanagawa (JP); Hiroshi Kikuchi, Kanagawa (JP); Yutaka Takahashi, Kanagawa (JP); Yusuke Ishizuka, Kanagawa (JP); Takuya Akiyama, Kanagawa (JP); Yutaka Goto, Kanagawa (JP); Kazuhiro Shimada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/707,315

(22) Filed: Mar. 29, 2022

(65) Prior Publication Data

US 2022/0317601 A1 Oct. 6, 2022

(30) Foreign Application Priority Data

Apr. 1, 2021 (JP) ..... 2021-062733

(51) Int. Cl.
*G03G 15/16* (2006.01)

(52) U.S. Cl.
CPC ..... *G03G 15/1675* (2013.01); *G03G 15/167* (2013.01)

(58) Field of Classification Search
CPC ..... G03G 15/1675; G03G 15/167
See application file for complete search history.

(56) References Cited

U.S. PATENT DOCUMENTS

| | | | | |
|---|---|---|---|---|
| 8,059,978 | B2 * | 11/2011 | Mizushima | G03G 15/1685 399/45 |
| 9,395,659 | B2 * | 7/2016 | Tanaka | G03G 15/1605 |
| 9,645,530 | B2 * | 5/2017 | Kochi | G03G 15/1675 |
| 9,740,156 | B2 * | 8/2017 | Wada | G03G 15/6591 |
| 11,281,130 | B2 * | 3/2022 | Kakehi | G03G 15/5029 |

(Continued)

FOREIGN PATENT DOCUMENTS

JP 2017-194669 10/2017

OTHER PUBLICATIONS

U.S. Appl. No. 17/486,921, filed Sep. 28, 2021.

*Primary Examiner* — Arlene Heredia
(74) *Attorney, Agent, or Firm* — Duft & Bornsen, PC

(57) ABSTRACT

An image forming apparatus includes an image bearer; a nip forming member configured to form a transfer nip between the image bearer and the nip forming member; a nip pressure changer configured to change a nip pressure of the transfer nip; a transfer bias applier configured to apply, to the transfer nip, a transfer bias in which an AC component is superimposed on a DC component; and a DC component adjuster configured to adjust the DC component in the transfer bias, according to the nip pressure that is changed by the nip pressure changer.

20 Claims, 19 Drawing Sheets

(56) References Cited

U.S. PATENT DOCUMENTS

2003/0104297 A1 6/2003 Matsuda et al.
2003/0186155 A1 10/2003 Aoki et al.
2004/0076443 A1 4/2004 Suzuki et al.
2004/0114971 A1 6/2004 Sakai et al.
2004/0136763 A1 7/2004 Murakami et al.
2004/0241566 A1 12/2004 Suzuki et al.
2005/0025535 A1 2/2005 Koichi et al.
2005/0030595 A1 2/2005 Koichi et al.
2005/0031374 A1 2/2005 Nagashima et al.
2005/0074264 A1 4/2005 Amemiya et al.
2005/0084271 A1 4/2005 Koike et al.
2005/0111882 A1 5/2005 Sudo et al.
2005/0164108 A1 7/2005 Murakami et al.
2005/0249533 A1 11/2005 Suda et al.
2006/0029435 A1 2/2006 Kasai et al.
2007/0059067 A1 3/2007 Tanaka et al.
2007/0122166 A1 5/2007 Takahashi et al.
2007/0248379 A1 10/2007 Onuma et al.
2008/0043083 A1 2/2008 Imoto et al.
2008/0205937 A1 8/2008 Hori et al.
2009/0022504 A1 1/2009 Kuwabara et al.
2010/0003058 A1 1/2010 Hori et al.
2010/0067934 A1 3/2010 Mihara et al.
2010/0129118 A1 5/2010 Kimura
2011/0058857 A1 3/2011 Hori et al.
2011/0058859 A1 3/2011 Nakamatsu et al.
2011/0091802 A1 4/2011 Takahashi et al.
2011/0171573 A1 7/2011 Sakata et al.
2011/0182610 A1 7/2011 Ohmura et al.
2011/0229207 A1 9/2011 Matsumoto et al.
2011/0229817 A1 9/2011 Yamada et al.
2012/0033998 A1 2/2012 Hori et al.
2012/0207492 A1 8/2012 Fujiwara et al.
2012/0230733 A1 9/2012 Kikuchi et al.
2012/0230738 A1 9/2012 Yoshizawa et al.
2012/0321341 A1 12/2012 Hori et al.
2013/0064570 A1 3/2013 Yamane et al.
2014/0119780 A1 5/2014 Hori et al.
2014/0241744 A1* 8/2014 Ichikawa ..... G03G 15/1615 399/45
2014/0376970 A1 12/2014 Kimura et al.
2015/0037050 A1 2/2015 Kimura et al.
2015/0037054 A1 2/2015 Nagata et al.
2015/0227086 A1 8/2015 Kondoh et al.
2015/0234318 A1 8/2015 Takahashi et al.
2015/0268591 A1 9/2015 Fujita et al.
2015/0331363 A1 11/2015 Takami et al.
2015/0338824 A1 11/2015 Shimizu et al.
2015/0355578 A1 12/2015 Kikuchi et al.
2015/0378284 A1 12/2015 Wada et al.
2016/0026113 A1 1/2016 Takahashi et al.
2016/0033915 A1 2/2016 Kumagai et al.
2016/0041498 A1 2/2016 Terai et al.
2016/0124346 A1 5/2016 Yamabe et al.
2016/0161887 A1 6/2016 Sugiura et al.
2016/0161888 A1 6/2016 Wada et al.
2016/0170363 A1 6/2016 Kogure et al.
2016/0202660 A1 7/2016 Terai et al.
2016/0334739 A1* 11/2016 Ohsugi ..... G03G 15/1605
2017/0090374 A1 3/2017 Fujita et al.
2017/0102638 A1 4/2017 Yamabe et al.
2017/0123373 A1 5/2017 Ogino et al.
2017/0227922 A1 8/2017 Takami et al.
2017/0248871 A1 8/2017 Iwatsuki et al.
2017/0261887 A1 9/2017 Ishizuka et al.
2017/0299987 A1 10/2017 Sugimoto et al.
2019/0204775 A1 7/2019 Takami et al.
2019/0339642 A1 11/2019 Takami et al.
2021/0033998 A1 2/2021 Kikuchi et al.
2021/0063919 A1 3/2021 Nakamoto et al.
2021/0200120 A1 7/2021 Takami et al.
2021/0223721 A1 7/2021 Goto et al.
2021/0333725 A1 10/2021 Nakamoto et al.
2022/0083828 A1 3/2022 Akiyama et al.

* cited by examiner

FIG.21

| PRESSURE SETTING | BIAS CORRECTION AMOUNT (AT TIME OF SHEET TRANSFER) | BIAS CORRECTION AMOUNT (AT TIME OF BELT TRANSFER) |
|---|---|---|
| 1 | 100% | 100% |
| 2 | 95% | 90% |
| 3 | 90% | 80% |
| 4 | 85% | 70% |

TRANSFER BIAS AND PRESSURE IN AN IMAGE FORMING APPARATUS

CROSS-REFERENCE TO RELATED APPLICATION

The present application is based on and claims priority under 35 U.S.C. § 119 to Japanese Patent Application No. 2021-062733, filed on Apr. 1, 2021, the contents of which are incorporated herein by reference in their entirety.

BACKGROUND OF THE INVENTION

1. Field of the Invention

The present invention relates to an image forming apparatus.

2. Description of the Related Art

Conventionally, there is known an image forming apparatus that includes an image bearer, a nip forming member for forming a transfer nip with respect to the image bearer, a nip pressure changing means for changing the nip pressure of the transfer nip, and a transfer bias applying means for applying a transfer bias, in which an alternating current (AC) component is superimposed on a direct current (DC) component, to the transfer nip.

For example, Patent Document 1 discloses an image forming apparatus that forms a secondary transfer nip with respect to an intermediate transfer belt (image bearer) by a sheet conveying belt (nip forming member) wound around a secondary transfer nip back roller. The image forming apparatus includes a nip pressure changing means for changing the pressurizing force of the pressurizing member for pressurizing the sheet conveying belt toward the intermediate transfer belt at the secondary transfer nip. In the image forming apparatus, control is performed so that the secondary transfer bias and the nip pressure of the secondary transfer nip differs between a high smoothness mode for transferring the toner image to a high smoothness sheet and a low smoothness mode for transferring the toner image to a low smoothness sheet. Specifically, in the high smoothness mode, the duty ratio of the AC component of the secondary transfer bias is higher than that of the low smoothness mode, and the nip pressure is smaller than that of the low smoothness mode, so that good transfer performance is achieved while preventing an abnormal image from being formed in both modes. The duty ratio is expressed as $(T-Tt)/T\times100$ [%], where Tt represents the time that the transfer bias is on the transfer side of moving the toner from the image bearer side to the nip forming member side, for a longer time than the average transfer bias time value, in the cycle T of the transfer bias.

Patent Document 1: Japanese Unexamined Patent Application Publication No. 2017-194669

SUMMARY OF THE INVENTION

According to one aspect of the present invention, there is provided an image forming apparatus including an image bearer; a nip forming member configured to form a transfer nip between the image bearer and the nip forming member; a nip pressure changer configured to change a nip pressure of the transfer nip; a transfer bias applier configured to apply, to the transfer nip, a transfer bias in which an AC component is superimposed on a DC component; and a DC component adjuster configured to adjust the DC component in the transfer bias, according to the nip pressure that is changed by the nip pressure changer.

BRIEF DESCRIPTION OF THE DRAWINGS

FIG. 21 is a table illustrating an example of a bias correction amount at each pressure setting during sheet transfer and belt transfer according to an embodiment of the present invention.

DESCRIPTION OF THE EMBODIMENTS

However, in a conventional image forming apparatus in which a transfer bias, in which an AC component is superimposed on a DC component, is applied to the transfer nip, when the nip pressure of the transfer nip is changed, it may be difficult to obtain good transfer performance in both a solid image and a halftone image.

Hereinafter, an embodiment in which the present invention is applied to a color printer of an electrophotographic method (hereinafter, simply referred to as a printer) as an image forming apparatus will be described.

Further, the field of application of the image forming apparatus is not limited to a printer, but may be applied to a copier, a facsimile machine, a multifunction peripheral having a copy function, a fax function, or the like.

Figure 1:
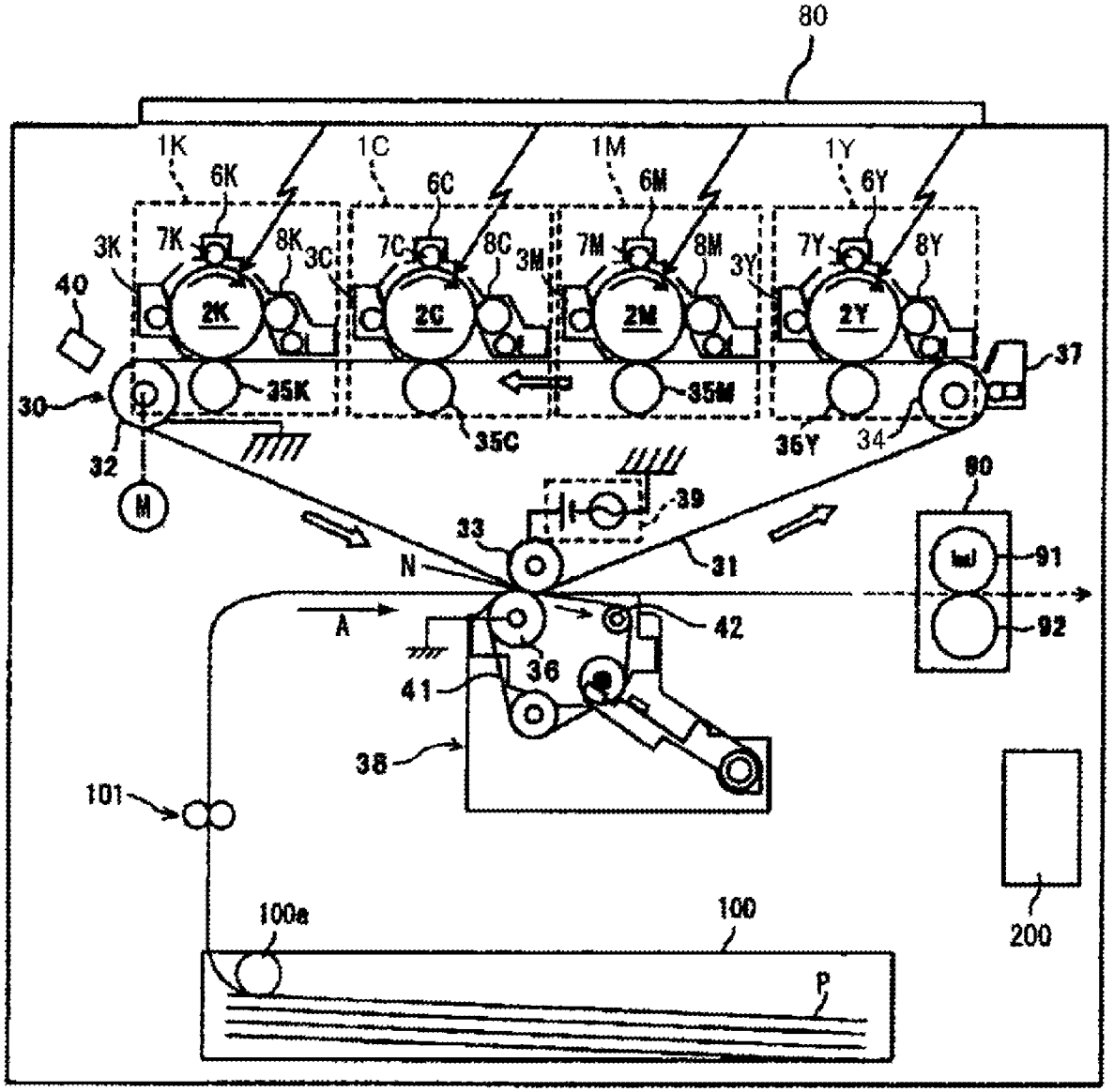
FIG. 1 is a schematic view of a configuration of a printer according to an embodiment of the present invention.

FIG. 1 is a schematic view illustrating a configuration of a printer according to the present embodiment.

The printer according to the present embodiment is provided with four toner image forming units 1Y, 1M, 1C, and 1K for forming toner images of yellow (Y), magenta (M), cyan (C), and black (K). The printer also includes a transfer unit 30, an optical writing unit 80, a fixing device 90, a feed cassette 100, a pair of resist rollers 101, and a control unit 200. The toner image forming units 1Y, 1M, 1C, and 1K include a process cartridge unit and are detachably supported by the housing of the printer, so as to be attached and detached at the time of performing maintenance and to enable unit replacement.

The four toner image forming units 1Y, 1M, 1C, and 1K use toner of different colors which are yellow, magenta, cyan, and black, respectively, but otherwise, the four toner image forming units have a similar configuration and are replaced at the end of the life-span. The toner image forming units 1Y, 1M, 1C, and 1K include the necessary configurations for forming a toner image in the electrophotographic process. That is, the toner image forming units 1Y, 1M, 1C, and 1K include drum-shaped photoconductors 2Y, 2M, 2C, and 2K as latent image bearers, drum cleaning devices 3Y, 3M, 3C, and 3K, a neutralization device, charging devices 6Y, 6M, 6C, and 6K, developing devices 8Y, 8M, 8C, and 8K, and the like.

The photoconductors 2Y, 2M, 2C, and 2K have an organic photosensitive layer formed on the surface of a drum substrate and are driven to rotate in a clockwise direction as viewed in the figure by a driving means. The charging devices 6Y, 6M, 6C, and 6K uniformly charge the surfaces of the photoconductors 2Y, 2M, 2C, and 2K by causing charging rollers 7Y, 7M, 7C, and 7K, which are charging members to which a charging bias is applied, to contact or approach the photoconductors 2Y, 2M, 2C, and 2K and perform discharging. In the present embodiment, the toner is uniformly charged to the same negative polarity as the normal charging polarity of the toner. As a charging bias, an AC voltage is superimposed on a DC voltage. A method using a charging charger may be performed instead of a method of causing a charging member, such as a charging roller, to contact or approach the photoconductor 2K.

The optical writing unit 80 optically scans the surfaces of the photoconductors 2Y, 2M, 2C, and 2K with laser light for each color emitted from a laser diode as an example of a light source based on image information transmitted from an external device such as a personal computer. On the surfaces of the uniformly charged photoconductors 2Y, 2M, 2C, and 2K, an electrostatic latent image corresponding to each color is formed by this optical scan. The optical writing unit 80 irradiates each photoconductor with laser light L of each color emitted from a light source through a plurality of optical lenses or mirrors, while deflecting the laser light L in a main scanning direction by a polygon mirror that is driven to rotate by a polygon motor. The light source may be one that writes light with LED light emitted from a plurality of LEDs of an LED array.

The electrostatic latent image of each of the colors is developed to become a toner image of each of the colors in a developing step by the developing devices 8Y, 8M, 8C, and 8K using toner, which is a developing agent and is a powder of each color of yellow (Y), magenta (M), cyan (C), and black (K). When the developing step of the toner image is completed, the printer performs a primary transfer step of primarily transferring the toner image formed on the photoconductors 2Y, 2M, 2C, and 2K to an intermediate transfer belt 31, as an image bearer and also an intermediate transfer element which will be described later.

The drum cleaning devices 3Y, 3M, 3C, and 3K are known ones for cleaning the residual transfer toner adhered to the surfaces of the photoconductors 2Y, 2M, 2C, and 2K after passing through the primary transfer nip. The neutralization device is a known device for removing residual electrical charges of the photoconductors 2Y, 2M, 2C, and 2K after the cleaning by the drum cleaning devices 3Y, 3M, 3C, and 3K. By this neutralization, the surfaces of the photoconductors 2Y, 2M, 2C, and 2K are initialized to be prepared for the next image formation.

Below the toner image forming units 1Y, 1M, 1C, and 1K, there is disposed a transfer unit 30 as a transfer device that causes the endless intermediate transfer belt 31 to move endlessly in a counterclockwise direction as viewed in the figure while stretching the endless intermediate transfer belt 31. The intermediate transfer belt 31 in the present embodiment is an elastic belt. The transfer unit 30 includes, in addition to the intermediate transfer belt 31 serving as an image bearer, a plurality of driving rollers 32 serving as rotating bodies, a secondary transfer back side roller 33, a cleaning backup roller 34, and four primary transfer rollers 35Y, 35M, 35C, and 35K. The transfer unit 30 also includes a belt cleaning device 37, a density sensor 40, and the like.

The intermediate transfer belt 31 is stretched by the driving roller 32 disposed inside the loop, the secondary transfer back side roller 33, the cleaning backup roller 34, and the four primary transfer rollers 35Y, 35M, 35C, and 35K. A driving motor M serving as a driving source is connected to the driving roller 32. The intermediate transfer belt 31 is endlessly moved in the same direction by the rotation force of the driving roller 32 which is driven to rotate in a counterclockwise direction as viewed in the figure by the driving motor M. The driving motor M is connected to the control unit 200. The control unit 200 rotates the driving motor M at a predetermined speed, thereby driving the intermediate transfer belt 31 to rotate at a predetermined linear speed.

The four primary transfer rollers 35Y, 35M, 35C, and 35K sandwich the intermediate transfer belt 31 which is moved endlessly, with the photoconductors 2Y, 2M, 2C, and 2K. Accordingly, the primary transfer nips for yellow, magenta, cyan, and black, at which the front side of the intermediate transfer belt 31 contacts the photoconductors 2Y, 2M, 2C, and 2K, are formed in the printer. Each of the primary transfer rollers 35Y, 35M, 35C, and 35K is applied with a primary transfer bias at a primary transfer timing by the primary transfer power supply. Accordingly, a transfer electric field for primary transfer is formed between the yellow, magenta, cyan, and black toner images on the photoconductors 2Y, 2M, 2C, and 2K, and the primary transfer rollers 35Y, 35M, 35C, and 35K.

For example, the Y toner image formed on the surface of the photoconductor 2Y for Y enters the primary transfer nip for Y as the photoconductor 2Y rotates. Then, the Y toner image is primarily transferred from the photoconductor 2Y to the intermediate transfer belt 31 by the function of a transfer electric field or nip pressure. The, the intermediate transfer belt 31 on which the Y toner image has been primarily transferred, sequentially passes through the primary transfer nips of magenta, cyan, and black. The magenta, cyan, and black toner images on the photoconductors 2M, 2C, and 2K are primarily transferred and sequentially superimposed on the Y toner image. The four-color superimposed toner image is formed on the intermediate transfer belt 31 by this superimposing process in the primary transfer step. The primary transfer rollers 35Y, 35M, 35C, and 35K may be replaced by a transfer charger or a transfer brush.

A sheet conveying unit 38 including a secondary transfer nip backing roller 36, a sheet conveying belt 41 (generally referred to as a secondary transfer belt, a transfer member, or the like), and the like, is disposed below the transfer unit 30. The endless sheet conveying belt 41, which is a nip forming member, is rotated in a clockwise direction as viewed in the figure while being stretched by a plurality of rollers, such as the secondary transfer nip backing roller 36 and a separation roller 42 disposed inside the loop. The intermediate transfer belt 31 is caused to contact the latching area with respect to the secondary transfer back side roller 33, the latching area being a portion in the entire area in the circumferential direction of the intermediate transfer belt 31, by the secondary transfer nip backing roller 36.

A secondary transfer back side roller 33 of the transfer unit 30 and the secondary transfer nip backing roller 36 of the sheet conveying unit 38 sandwich the intermediate transfer belt 31 and the sheet conveying belt 41 between each other. Accordingly, the secondary transfer nip N, as a transfer nip in which the front side of the intermediate transfer belt 31 contacts the front side of the sheet conveying belt 41 serving as a nip forming member, is formed.

The secondary transfer nip backing roller 36 disposed in the loop of the sheet conveying belt 41 is connected to ground, while the secondary transfer bias is applied to the secondary transfer back side roller 33 disposed in the loop of the intermediate transfer belt 31, as a transfer bias by a secondary transfer power supply 39. Accordingly, a transfer current flows between the secondary transfer back side roller 33 and the secondary transfer nip backing roller 36, and a secondary transfer electric field that moves the toner having the negative polarity from the secondary transfer back side roller 33 side to the secondary transfer nip backing roller 36 side, is formed in the secondary transfer nip N. That is, the printer is configured to apply a transfer bias to the secondary transfer nip N by a transfer power supply, and to apply a transfer current to the secondary transfer nip N.

As the nip forming member, a secondary transfer roller may be used instead of the sheet conveying belt 41, and the secondary transfer roller may come into direct contact with the intermediate transfer belt 31. Further, the secondary transfer nip backing roller 36 may be applied with a secondary transfer bias by the secondary transfer power supply 39, and the secondary transfer back side roller 33 may be connected to ground.

A feed cassette 100 is disposed underneath the transfer unit 30 and houses a plurality of recording sheets P stacked in a paper bundle. The feed cassette 100 causes a sheet feeding roller 100*a* to contact the recording sheet P at the top of the paper bundle and rotates the sheet feeding roller 100*a* at a predetermined timing to feed the recording sheet P to a feed passage. A pair of resist rollers 101 is disposed near the leading end of the feed path. The pair of resist rollers 101 is driven to rotate at a timing such that the recording sheet P fed from the feed cassette 100 is synchronized with the four-color superimposed toner image on the intermediate transfer belt 31 at the secondary transfer nip N, and delivers the recording sheet P toward the secondary transfer nip N.

The four-color superimposed toner image on the intermediate transfer belt 31 that contacts the recording sheet P at the secondary transfer nip N is secondarily transferred at once onto the recording sheet P by the function of the secondary transfer electric field (transfer current) due to the secondary transfer bias or the transfer nip pressure. In this manner, the secondary transfer step is performed, and the recording sheet P on which the full color toner image is formed on the front side is passed through the secondary transfer nip N, and then the recording sheet P is curvedly separated from the intermediate transfer belt 31. Further, the recording sheet P after transfer is curvedly separated from the sheet conveying belt 41 by the curvature of the separation roller 42 around which the sheet conveying belt 41 is wound.

On the intermediate transfer belt 31 after passing through the secondary transfer nip N, residual transfer toner that was not transferred to the recording sheet P is attached. The residual transfer toner is cleaned from the belt surface by the belt cleaning device 37 contacting the front side of the intermediate transfer belt 31 at a position facing the cleaning backup roller 34, in the cleaning step.

The printer includes the density sensor 40 as a toner density detecting means. The density sensor 40 is disposed outside of the loop of the intermediate transfer belt 31 and faces the latching point with respect to the driving roller 32 via a predetermined gap, the latching point being a portion of the entire area in the circumferential direction of the intermediate transfer belt 31. In this state, when the toner image that is primarily transferred onto the intermediate transfer belt 31 enters the position facing the density sensor 40, the density sensor 40 detects the toner adherence amount (image density) per unit area of the toner image.

The fixing device 90 is disposed at a downstream side of the secondary transfer nip N in the sheet conveying direction represented by an arrow A. The fixing device 90 forms a fixing nip by a fixing roller 91 that includes a heat source and a pressurizing roller 92 that rotates while being in contact with the fixing roller by predetermined pressure. The fixing device 90 softens the toner in the toner image by heating and pressing by passing the recording sheet P, that has undergone the secondary transfer, through the fixing nip, in the fixing step, and fixes the full color image onto the recording sheet P. The recording sheet P that has passed through the fixing nip is ejected from the inside of the fixing device 90, and after passing through the post-fixing conveyance path, the recording sheet P is ejected to the outside of the printer.

When forming a monochrome image, the printer according to the present embodiment changes the orientation of a support plate supporting the primary transfer rollers 35Y, 35M, and 35C for yellow, magenta, and cyan in the transfer unit 30 by driving a solenoid or the like. Accordingly, the primary transfer rollers 35Y, 35M, and 35C for yellow, magenta, and cyan are moved away from the photoconductors 2Y, 2M, and 2C, and the front side of the intermediate transfer belt 31 is separated from the photoconductors 2Y, 2M, and 2C. In this way, among the four toner image forming units 1Y, 1M, 1C, and 1K, only the toner image forming unit 1K for black is driven while the intermediate transfer belt 31 is in contact with only the photoconductor 2K for black, and a black K toner image is formed on the photoconductor 2K. An embodiment of the present invention can be applied not only to an image forming apparatus that forms a color image but also to an image forming apparatus that forms only a monochrome image.

Figure 2:
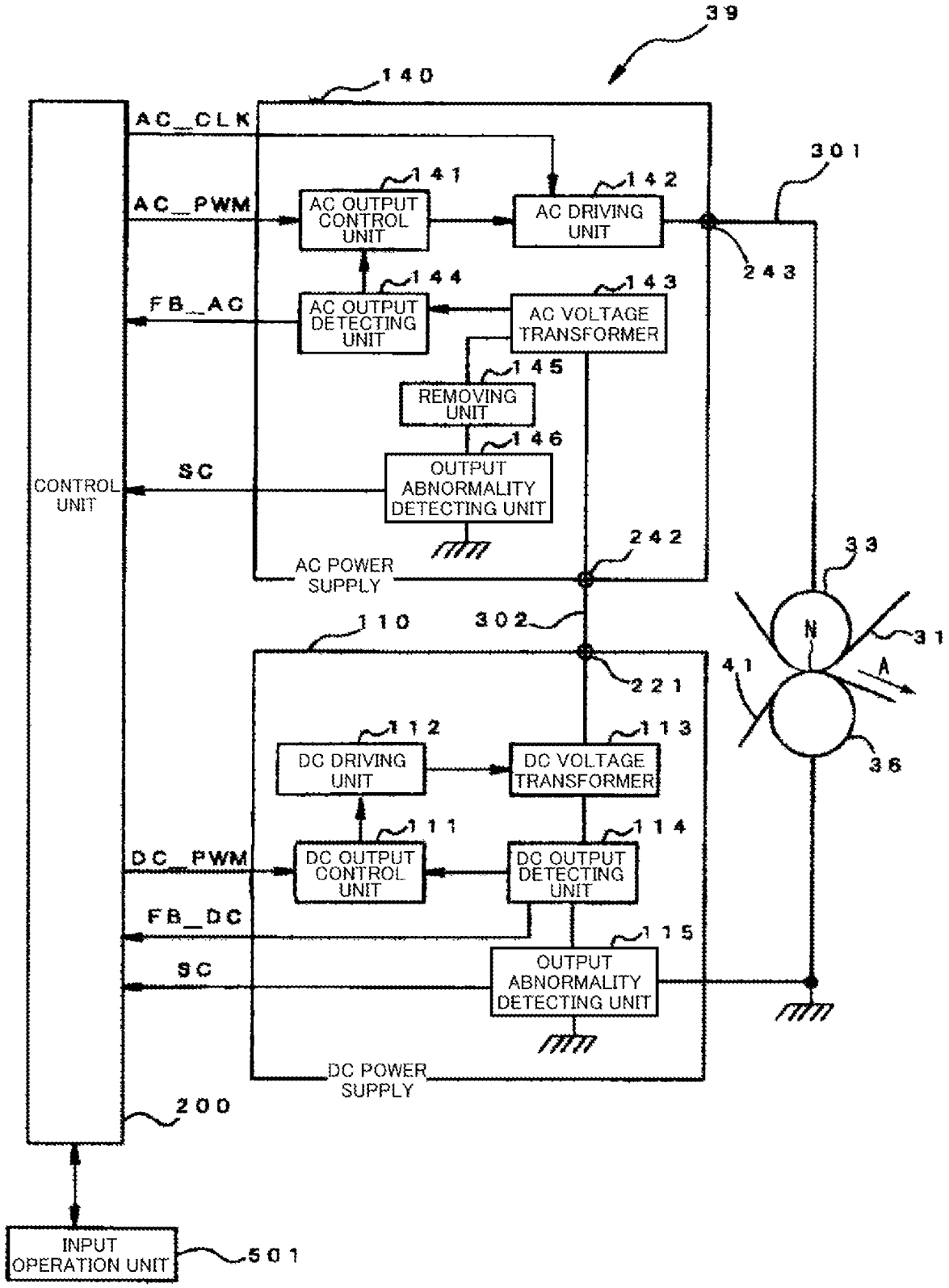
FIG. 2 is a block diagram illustrating the main parts of an electric circuit of a secondary transfer power supply in the printer together with a secondary transfer back side roller, a secondary transfer nip backing roller, a control unit, and the like according to an embodiment of the present invention.

FIG. 2 is a block diagram illustrating the essential parts of the electric circuit of the secondary transfer power supply 39 together with the secondary transfer back side roller 33, the secondary transfer nip backing roller 36, the control unit 200, and the like.

The secondary transfer power supply 39 includes a DC power supply 110 and an AC power supply 140. The secondary transfer power supply 39 is controlled by the control unit 200 as a DC component adjusting means and a duty ratio changing means. The control unit 200 also controls the operation of a nip pressure changing device, which will be described later.

The DC power supply 110 is a power supply for outputting a DC voltage that is a DC component for applying, to the toner on the surface of the intermediate transfer belt 31, an electrostatic force from the intermediate transfer belt side toward the recording sheet side within the secondary transfer nip N. The DC power supply 110 includes a DC output control unit 111, a DC driving unit 112, a DC voltage transformer 113, a DC output detecting unit 114, an output abnormality detecting unit 115, and an electrical connection unit 221.

The AC power supply 140 is a power supply that outputs an AC voltage that is an AC component for forming an electric field in the secondary transfer nip N. The AC power supply 140 includes an AC output control unit 141, an AC driving unit 142, an AC voltage transformer 143, an AC output detecting unit 144, a removing unit 145, an output abnormality detecting unit 146, an electrical connection unit 242, and an electrical connection unit 243.

The control unit 200 controls the DC power supply 110 and the AC power supply 140 and is configured by a control device including a Central Processing Unit (CPU), a Read Only Memory (ROM), a Random Access Memory (RAM), and the like. The DC output control unit 111 receives, from the control unit 200, a DC_PWM signal that controls the output magnitude of the DC voltage. The DC output control unit 111 further receives the output value of the DC voltage transformer 113 detected by the DC output detecting unit 114. The DC output control unit 111 performs the following control based on the duty ratio included in the input DC_PWM signal and the output value of the DC voltage transformer 113. That is, the driving of the DC voltage transformer 113 is controlled through the DC driving unit 112 so that the output value of the DC voltage transformer 113 becomes the output value instructed by the DC_PWM signal.

The DC driving unit 112 drives the DC voltage transformer 113 according to control by the DC output control unit 111. The DC voltage transformer 113 is driven by the DC driving unit 112 to provide a DC high voltage output of a negative polarity. The electrical connection unit 221 and the electrical connection unit 242 are electrically connected by a harness 302, and, therefore, the DC voltage transformer 113 outputs a DC voltage via the harness 302 to the AC power supply 140.

The DC output detecting unit 114 detects the output value of the DC high voltage from the DC voltage transformer 113 and outputs the output value to the DC output control unit 111. The DC output detecting unit 114 outputs the detected output value as an FB_DC signal (a feedback signal) to the control unit 200. This is to control the duty ratio of the DC_PWM signal at the control unit 200 so that the transfer performance is not reduced by the environment or the load.

The output abnormality detecting unit 115 is disposed on the output line of the DC power supply 110 and outputs an SC signal indicating an output abnormality, such as a leak, to the control unit 200 when an output abnormality occurs due to a ground fault of the electric wire or the like. This allows the control unit 200 to perform control for stopping the high voltage output from the DC power supply 110.

The AC output control unit 141 receives, from the control unit 200, an AC_PWM signal for controlling the magnitude of the AC voltage output and an output value of the AC voltage transformer 143 detected by the AC output detecting unit 144. The AC output control unit 141 performs the following control based on the duty ratio of the input AC_PWM signal and the output value of the AC voltage transformer 143. That is, the driving of the AC voltage transformer 143 is controlled through the AC driving unit 142 so that the output value of the AC voltage transformer 143 becomes the output value instructed by the AC_PWM signal.

The AC driving unit 142 receives an AC_CLK signal that controls the output frequency of the AC voltage. The AC driving unit 142 drives the AC voltage transformer 143 based on control by the AC output control unit 141 and an AC_CLK signal. The AC driving unit 142 can control the output waveform generated by the AC voltage transformer 143 to any frequency instructed by the AC_CLK signal by driving the AC voltage transformer 143 based on the AC_CLK signal.

The AC voltage transformer 143 is driven by the AC driving unit 142 to generate an AC voltage, which is superimposed on a DC high voltage output from the DC voltage transformer 113 to generate a superimposed voltage. The AC voltage transformer 143 applies the generated superimposed voltage to the secondary transfer back side roller 33 through the harness 301. When the AC voltage transformer 143 does not generate an AC voltage, the AC voltage transformer 143 outputs (applies) the DC high voltage output from the DC voltage transformer 113 to the secondary transfer back side roller 33 through the harness 301.

The AC output detecting unit 144 detects the output value of the AC voltage of the AC voltage transformer 143 and outputs the detected output value to the AC output control unit 141. The detected output value is output to the control unit 200 as an FB_AC signal (feedback signal). This is because the duty ratio of the AC_PWM signal is controlled by the control unit 200 so that the transfer performance is not reduced by the environment or the load. Although the AC power supply 140 performs constant voltage control, constant current control may be performed. The AC voltage waveform generated by the AC voltage transformer 143 (the AC power supply 140) may be a sine wave, a square wave, or any other waveform.

The secondary transfer power supply 39 outputs a DC voltage by a constant voltage control method that adjusts the output current value so that the output voltage value matches a predetermined target voltage value. Further, the AC voltage is output by a constant voltage control method in which the amplitude is adjusted so that the peak-to-peak value Vpp (see FIG. 6) of the AC component of the secondary transfer bias is matched to the predetermined target value. As in the present embodiment, if the transfer electric field of the secondary transfer nip is formed by using an electric field that is configured by the superimposed voltage as the secondary transfer bias, the toner can be secondarily transferred with good properties to recessed portions of the surface of the recording sheet having low smoothness, such as a rough sheet having the many irregularities.

The control unit 200 controls the driving of various driving bodies in the printer, receives the detection result of various sensors, and performs calculation processing. The driving of the toner image forming unit 1Y, 1M, 1C, and 1K, the optical writing unit 80, the driving motor M of the intermediate transfer belt 31, and the like is controlled by the control unit 200.

Next, a characteristic configuration of the printer according to the embodiment will be described.

Figure 3:
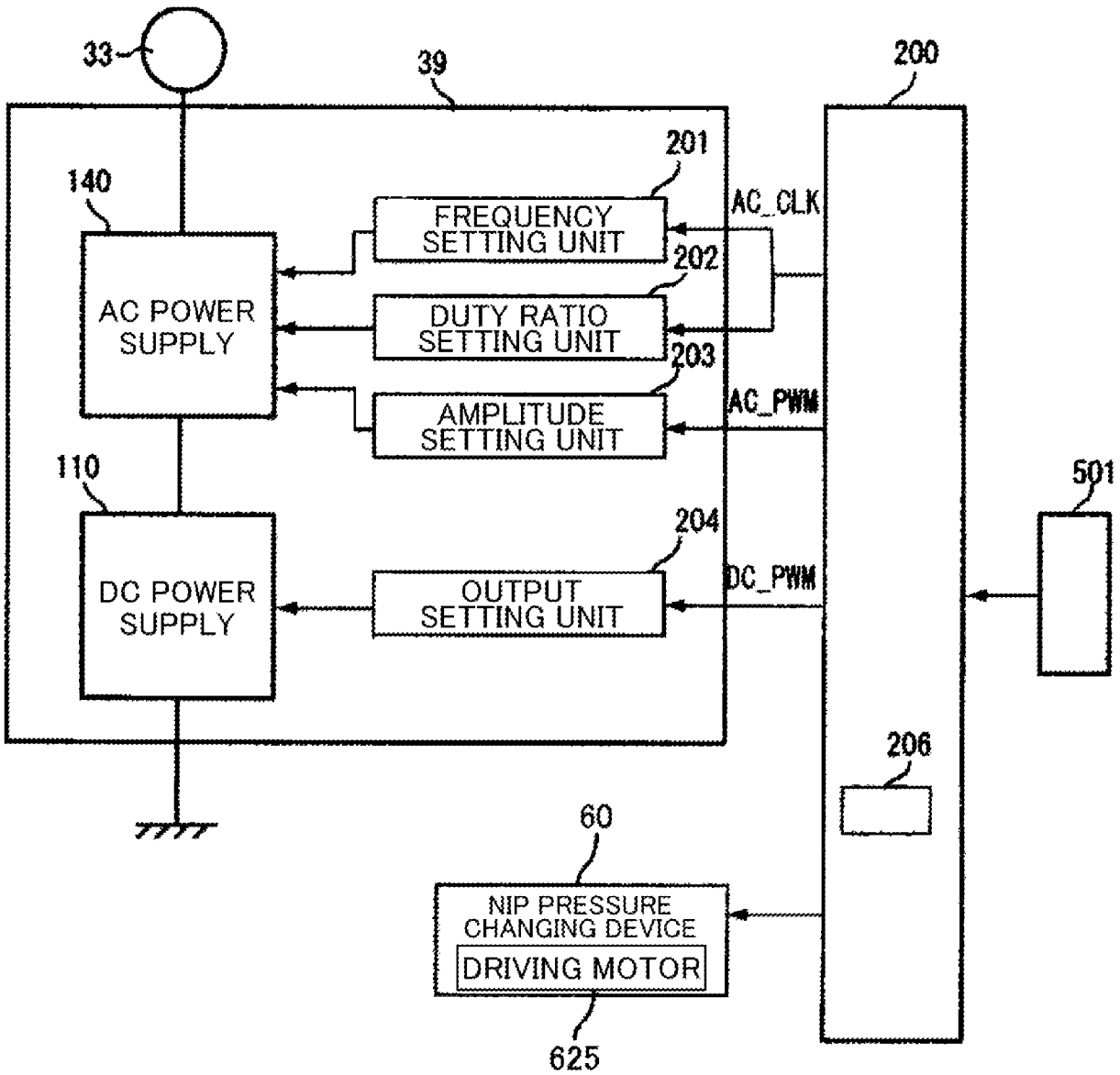
FIG. 3 is a block diagram schematically illustrating the configuration of a control system of the printer according to an embodiment of the present invention.

FIG. 3 is a block diagram schematically illustrating a configuration of a control system of a printer, wherein the secondary transfer power supply 39 described in FIG. 2 is functionally described.

The control unit 200 outputs various signals on the basis of various kinds of information input to the input unit to control the operation of devices connected to the output unit. In the present embodiment, as described above, the secondary transfer power supply 39 and a nip pressure changing device 60 described below are connected to each other through a signal line to control the output of the transfer bias output from the secondary transfer power supply 39 and the operation of the nip pressure changing device 60.

The printer includes a frequency setting unit 201, a duty ratio setting unit 202, an amplitude setting unit 203, and an output setting unit 204. The frequency setting unit 201, the duty ratio setting unit 202, and the amplitude setting unit 203 are connected to the AC power supply 140 through a signal line, and the output setting unit 204 is connected to the DC power supply 110 through a signal line.

The frequency setting unit 201 changes the frequency of the AC component output from the AC power supply 140. The duty ratio setting unit 202 sets the voltage in the direction in which toner in the AC voltage waveform is transferred to the recording sheet P by changing the duty ratio of the voltage in the range of 0% to 100%. The frequency setting unit 201 and the duty ratio setting unit 202 respectively control the frequency and the duty ratio by the AC_CLK illustrated in FIG. 3. The amplitude setting unit 203 sets the maximum voltage difference (peak to peak value Vpp) of the AC voltage output from the AC power supply 140. The amplitude setting unit 203 is controlled by the AC_PWM signal illustrated in FIG. 3.

The output setting unit 204 sets the constant voltage of the DC voltage generated by the DC power supply 110 according to the control of the control unit 200. The output setting unit 204 is controlled by the DC_PWM signal illustrated in FIG. 2.

The frequency setting unit 201, the duty ratio setting unit 202, the amplitude setting unit 203, and the output setting unit 204 may be included in the secondary transfer power supply 39, or may be provided separately from the secondary transfer power supply 39, such as being included in the control unit 200 or being included in another control device.

Figure 4:
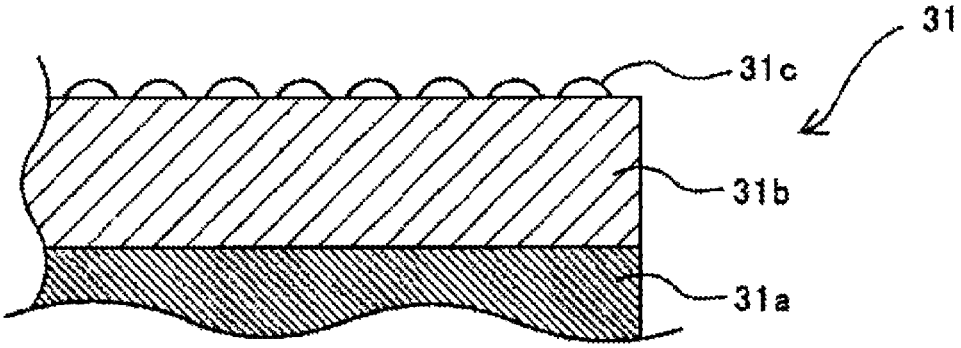
FIG. 4 is an enlarged cross-sectional view partially illustrating a cross-section of an intermediate transfer belt made of an elastic belt mounted in the printer according to an embodiment of the present invention.

FIG. 4 is an enlarged cross-sectional view that partially illustrates the cross-section of the intermediate transfer belt 31 made of an elastic belt mounted in the printer according to the present embodiment.

Figure 5:
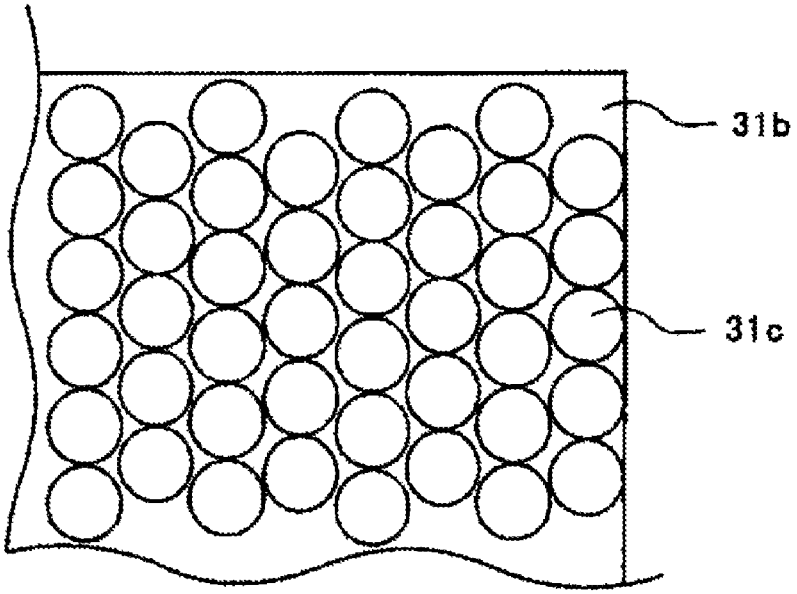
FIG. 5 is an enlarged plan view illustrating the intermediate transfer belt partially enlarged according to an embodiment of the present invention.

The intermediate transfer belt 31 includes an endless belt-like base layer (a belt substrate of a hard material) 31*a* made of a material having a certain degree of flexibility and high stiffness, and an elastic layer 31*b* made of a highly flexible elastic material laminated on the front side of the base layer 31*a*. The elastic layer 31*b* is an elastic surface layer in which particles 31*c* are dispersed so as to be densely packed in the belt surface direction, as illustrated in FIG. 5, with some of the particles 31*c* protruding from the surface of the elastic layer 31*b*. The plurality of particles 31*c* forms a plurality of protrusions on the belt surface. That is, the intermediate transfer belt 31 has an elastic surface layer as the elastic layer 31*b*, and a plurality of micro-protrusions, formed by a plurality of the particles (fine particles) 31*c* dispersed in the material, are disposed on the surface of the elastic surface layer (the surface of the elastic layer 31*b*).

As the material of the base layer 31*a*, an example of a material in which an electrical resistance adjusting material, such as a filler material or an additive material for adjusting electrical resistance, is dispersed in a resin, can be given. As the resin, for example, a fluorine-based resin such as PVDF (polyvinylidene fluoride) and EBE (ethylene-tetrafluoroethylene copolymer) or a polyimide resin or a polyamide-imide resin is preferable from the viewpoint of flame retardance. Further, from the viewpoint of mechanical strength (high elasticity) and heat resistance, polyimide resins or polyamide-imide resins are particularly suitable.

As the electrical resistance adjusting material dispersed in the resin, a metal oxide, carbon black, an ion conductivity agent, a conductive polymer material, and the like can be exemplified. Examples of the metal oxide include zinc oxide, tin oxide, titanium oxide, zirconium oxide, aluminum oxide, silicon oxide, and the like. In order to improve the dispersibility, the metal oxide that has been subjected to surface treatment in advance may be used. Examples of carbon black include ketchen black, furnace black, acetylene black, thermal black, gas black, and the like. Ion conductivity agents include tetraalkylammonium salts, trialkylbenzylammonium salts, alkylsulfonates, and alkylbenzenesulfonates. Alkyl sulfate, glycerol fatty acid ester, sorbitan fatty acid ester, polyoxyethylene alkylamine, polyoxyethylene fatty acid alcohol ester, alkyl betaine, lithium perchlorate, and the like may also be used. The ionic conductors thereof may be used by mixing two or more types. Note that the electrical resistance adjusting member to which an embodiment of the present invention is applicable, is not limited to those illustrated in the examples heretofore.

The coating liquid that is the precursor of the base layer 31*a* (a coating liquid in which the electrical resistance adjusting material is dispersed in a liquid resin before curing) may, if necessary, be supplemented with dispersion aids, reinforcing materials, lubricants, heat transfer materials, antioxidants, and the like. The added amount of electrical resistance adjusting material preferably contained in the base layer 31*a* of the endless belt preferably provided as the intermediate transfer belt 31 is an amount such that surface resistivity is $1\times10^{8}$ to $1\times10^{13}$ [Ω/□] and the volume resistivity is $1\times10^{6}$ to $1\times10^{12}$ [Ω·cm] in volume resistivity.

The thickness of the base layer 31*a* is not particularly limited and may be optionally selected depending on the situation, but is preferably from 30 μm to 150 μm, more preferably from 40 μm to 120 μm, and particularly preferably from 50 μm to 80 μm.

As described above, the elastic layer 31*b* of the intermediate transfer belt 31 has a plurality of protruding shapes formed by a plurality of dispersed particles 31*c* on the surface. General-purpose resins, elastomers, rubbers, and the like may be exemplified as the elastic material for forming the elastic layer 31*b*. In particular, it is preferable to use an elastic material with excellent flexibility (elasticity), and an elastomer material or rubber material is preferable. Examples of elastomer material may be polyester-based, polyamide-based, polyether-based, polyurethane-based, polyolefin-based, polystyrene-based, polyacrylic-based, polydiene-based, silicone-modified polycarbonate-based, and the like. A thermoplastic elastomer such as a fluorinated copolymer may be used. The thermosetting resin may be a polyurethane resin, a silicone modified epoxy resin, a silicone modified acrylic resin, or the like. Examples of the rubber material include isoprene rubber, styrene rubber, butadiene rubber, nitrile rubber, ethylene propylene rubber, butyl rubber, silicone rubber, chloroprene rubber, acrylic rubber, and the like. Further, chlorosulfonated polyethylene, fluorinated rubber, urethane rubber, hydrin rubber, and the like may be exemplified. It is possible to select, as appropriate, a material with the desired performance from among the materials described above.

Among the elastic materials configuring the elastic layer 31*b*, acrylic rubber is most preferable from the viewpoints of ozone resistance, flexibility, adhesion to particles, flame retardancy, environmental stability, and the like. The acrylic rubber may be one that is commercially available and is not limited to a particular product. However, among the various crosslinking systems (an epoxy group, an active chlorine group, and a carboxyl group) of acrylic rubber, those of carboxyl crosslinking systems are excellent in terms of rubber physical properties (especially compression set) and processability. Therefore, it is preferable to select those of carboxyl crosslinking systems. As the crosslinking agent used for the acrylic rubber of the carboxyl cross-linking system, the amine compound is preferred, and the polyvalent amine compound is most preferred. Examples of such amine compounds include aliphatic polyamine crosslinkers, aromatic polyamine crosslinkers, and the like.

The acrylic rubber used for the elastic layer 31*b* may be mixed with a crosslinking promoter in order to facilitate the above-described crosslinking reaction of the crosslinking agent. The type of crosslinking promoter is not particularly limited, but it is preferable that the crosslinking agent can be used in combination with the above-described polyamine crosslinking agent.

The acrylic rubber used for the elastic layer 31*b* preferably has an electrical resistance adjusting material added thereto. The amount added is preferably adjusted such that the resistance value of the elastic layer 31*b* is in the range of $1\times10^{8}$ to $1\times10^{13}$ [Ω/□] in surface resistivity and $1\times10^{6}$ to $1\times10^{12}$ [Ω·cm] in volume resistivity. The layer thickness of the elastic layer 31*b* is preferably 200 μm to 2 mm and more preferably 400 μm to 1000 μm.

As the particles 31*c* dispersed in the elastic material of the elastic layer 31*b*, resin particles that have an average particle diameter of 100 μm or less, that have a spherical shape, that are insoluble to an organic solvent, and that have a 3% pyrolysis temperature of 200° C. or more, are used. The resinous material of the particles 31*c* may be exemplified by acrylic resin, melamine resin, polyamide resin, polyester resin, silicone resin, fluorine resin, rubber, and the like, although not limited thereto. The surfaces of the base particles configured by these resinous materials may be surfaces treated with heterologous materials. The surface of the rubber spherical base particles may be coated by hard resin. The base particles may be hollow or porous. It is also possible to use a material in which the particles 31*c* are not dispersed in the elastic layer 31*b*, as the intermediate transfer belt 31.

As illustrated in FIG. 5, there is almost no overlap observed between the particles 31*c* on the surface of the intermediate transfer belt 31. It is preferable that the diameters of the cross-sections of the particles 31*c* on the surface of the elastic layer 31*b* are as uniform as possible, and specifically, it is preferable that the diameters of these particles 31*c* have a distribution width of ±(average particle diameter×0.5) μm or less. In order to achieve such a distribution width, it is preferable to use a particle powder having a narrow particle size distribution. However, a particle powder having a wide particle size distribution may be used if the elastic layer 31*b* is formed by using a method in which the particles 31*c* having a specific particle size are selectively localized on the surface.

As the recording sheet P, a sheet type having a surface with many irregularities, such as Japanese paper, is assumed to be used. In this case, in order to effectively secondarily transfer the toner into the plurality of recessed portions on the surface of the recording sheet P and prevent irregularities in the image density similar to the surface irregularities, it is necessary to use the elastic layer 31*b* that has a certain degree of flexibility (elasticity). When such an elastic layer 31*b* is used, if the elastic layer 31*b* is used alone, the elastic layer 31*b* will quickly undergo elongation upon being stretched, and thus cannot tolerate practical use. Therefore, it is an essential condition to provide the base layer 31*a* that is stiffer than the elastic layer 31*b* and prevent the elongation of the entire belt for a long period of time by the stiffness of the base layer 31*a*.

As described above, in the printer according to the embodiment, the intermediate transfer belt 31 that is made of an elastic belt having the elastic layer 31*b* stacked on top of the base layer 31*a* is used. Accordingly, even when an image is formed at an ultra-high speed for a business user, at a belt line speed (process line speed)=630 [mm/s], the toner transfer rate into the recessed portions on the sheet surface of a sheet with irregularities can be ensured, and it is possible to prevent irregularities in the image density similar to the surface irregularities of the sheet with irregularities.

Figure 6:
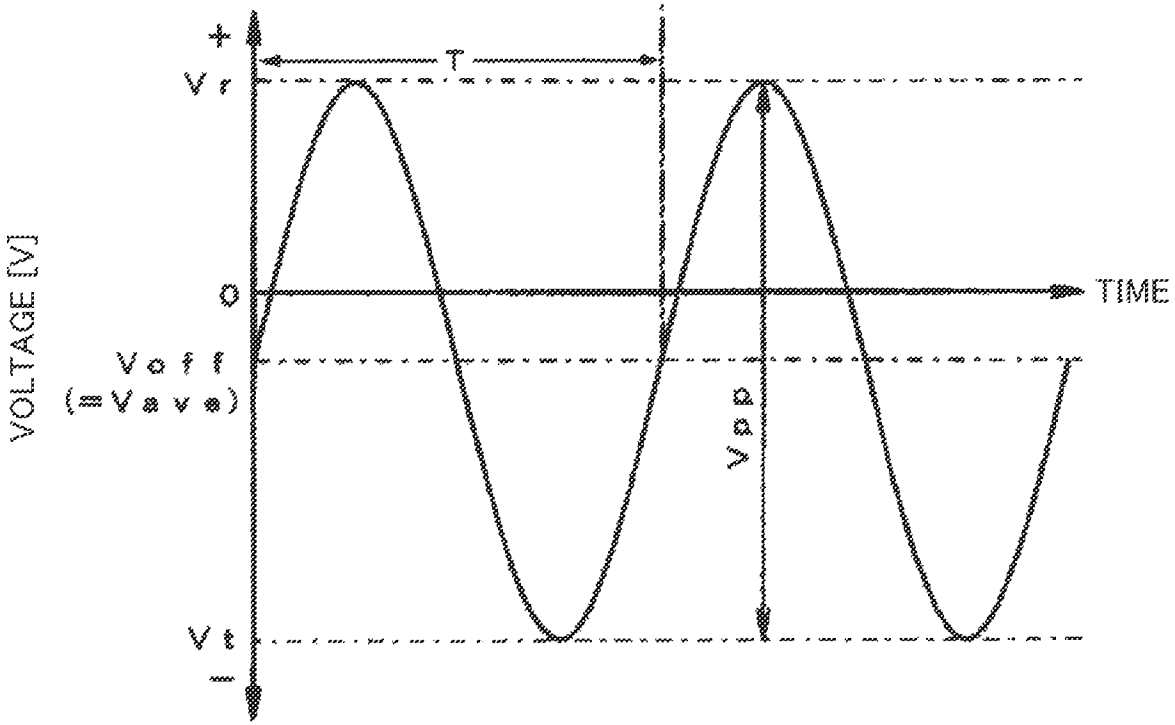
FIG. 6 is a graph illustrating an example of a waveform of the secondary transfer bias formed of the superimposed voltages output from the secondary transfer power supply according to an embodiment of the present invention.

FIG. 6 is a graph illustrating an example of a waveform of the secondary transfer bias formed of the superimposed voltages output from the secondary transfer power supply 39.

The waveform of the secondary transfer bias illustrated in the figure is a sine wave. The offset voltage Voff is the value of the DC component (DC voltage) of the secondary transfer bias formed of the superimposed voltages. The offset voltage Voff in the figure is negative in polarity. When the waveform of the secondary transfer bias is a sine wave as illustrated in the figure, the offset voltage Voff and the time average value Vave, which is the average potential per cycle (T) of the secondary transfer bias, become the same value. Accordingly, in the figure, the time average value Vave of the transfer bias has negative polarity.

In the configuration in which the secondary transfer bias is applied to the cored bar of the secondary transfer back side roller 33 as in the printer of the present embodiment, when the polarity of the secondary transfer bias is the same as a normal charging polarity of the toner, the toner inside the secondary transfer nip N moves in the transfer direction. Specifically, the toner moves from the surface of the intermediate transfer belt 31 to the surface of the recording sheet inside the secondary transfer nip N. When the polarity of the secondary transfer bias becomes a polarity opposite to the normal charging polarity of the toner, the toner inside the secondary transfer nip moves in a direction opposite to the transfer direction. Specifically, the toner moves from the surface of the recording sheet toward the surface of the intermediate transfer belt 31. The time average value Vave is made a negative polarity which is the same as the normal charging polarity of the toner, so that the toner moves back and forth between the belt surface side and the sheet surface side in the secondary transfer nip, while moving relatively from the belt surface side to the sheet surface side. Therefore, it is possible to secondarily transfer the toner image on the surface of the intermediate transfer belt 31 onto the surface of the recording sheet P.

In FIG. 6, the transfer peak value Vt is one of two peak values that occur within one cycle T of the secondary transfer bias, and is the peak value that causes the toner to be electrostatically moved from the surface of the belt to the surface of the sheet more strongly within the secondary transfer nip. The reverse peak value Vr is the peak value other than the transfer peak value Vt. In the secondary transfer bias illustrated in FIG. 6, the reverse peak value Vr is in a reversed polarity (positive polarity) from the transfer peak value Vt. The transfer peak value Vt is on the transfer side (the negative polarity side) relative to the time average value Vave. The reverse peak value Vr is a peak value different from the transfer peak value Vt and is on the opposite side (+ polarity side) from the transfer side as viewed from the time average value Vave.

Figure 7:
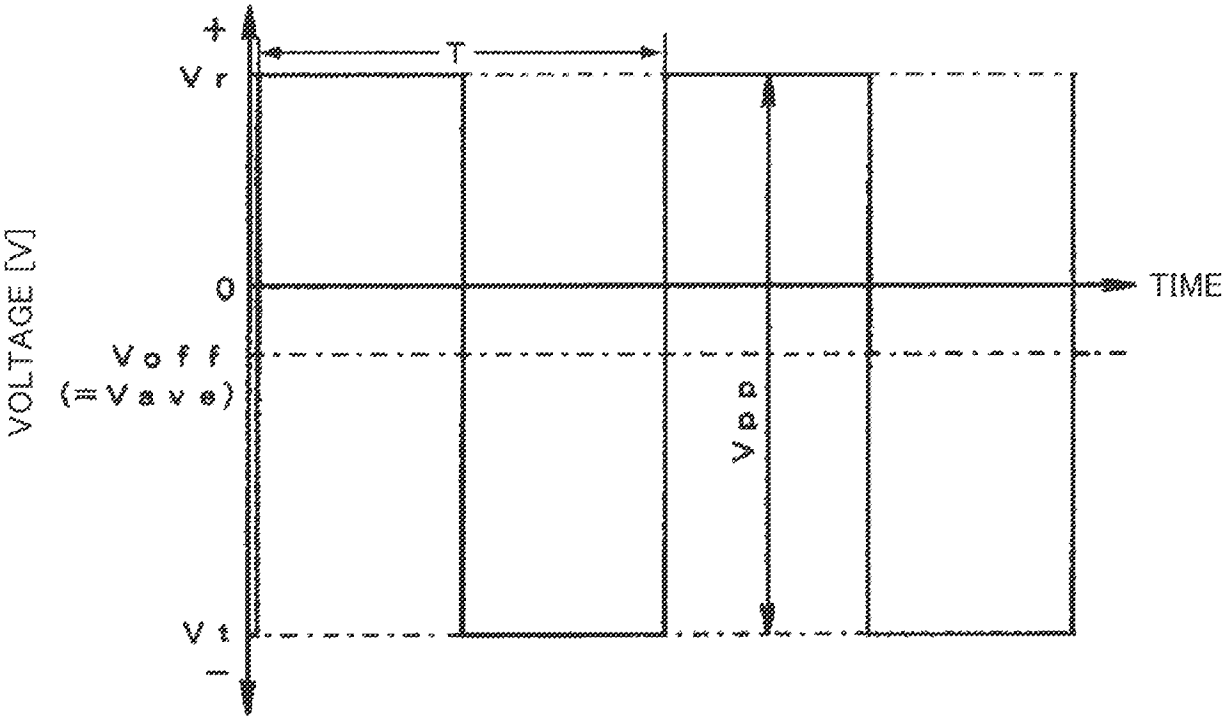
FIG. 7 is a graph illustrating another example of a waveform of a secondary transfer bias formed of superimposed voltages according to an embodiment of the present invention.

The waveform of the secondary transfer bias output from the secondary transfer power supply 39 is not limited to a sine wave as illustrated in FIG. 6. A secondary transfer bias of a triangular wave or a square wave may be used. FIG. 7 is a graph illustrating another example of a waveform of the secondary transfer bias formed of superimposed voltages. The waveform of the secondary transfer bias illustrated in the figure is a rectangular wave. The sine wave of the secondary transfer bias illustrated in FIG. 6 and the square wave of the secondary transfer bias illustrated in FIG. 7 all have a duty ratio of 50 [%]. In any of the secondary transfer biases formed of waveforms having such characteristics, the time average value Vave per cycle (T) becomes the same value as the offset voltage Voff. That is, the value of the DC component is the same as the time average value Vave.

Figure 8:
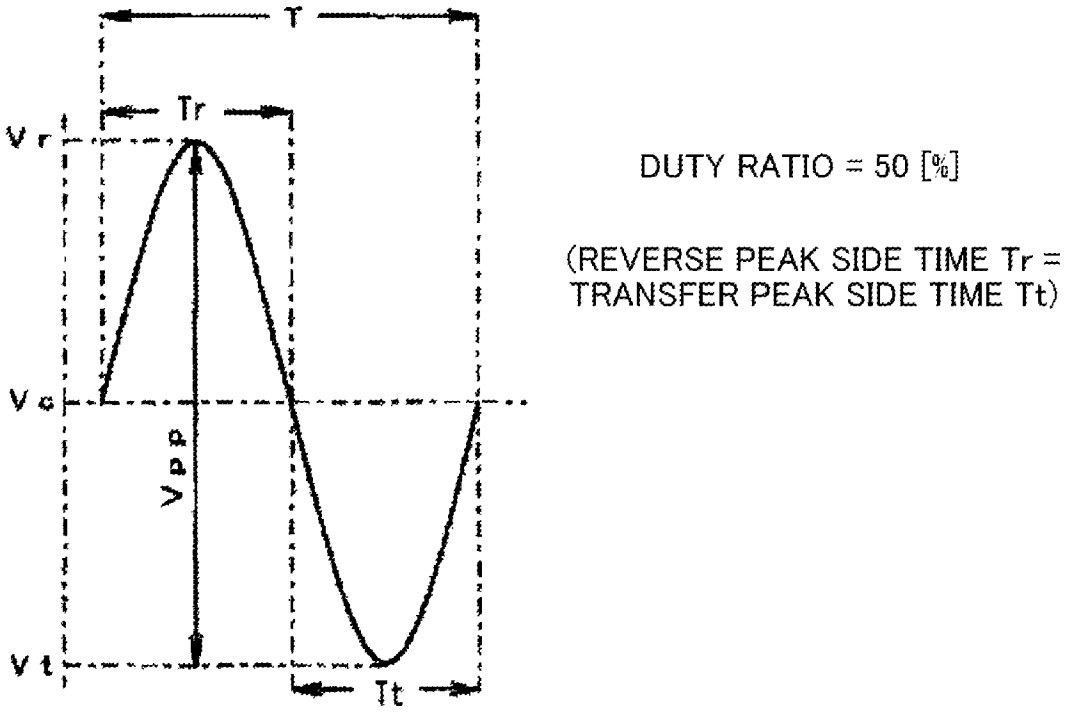
FIG. 8 is a graph illustrating the duty ratio in the secondary transfer bias illustrated in FIG. 6 according to an embodiment of the present invention.

FIG. 8 is a graph illustrating the duty ratio in the secondary transfer bias illustrated in FIG. 6.

Figure 9:
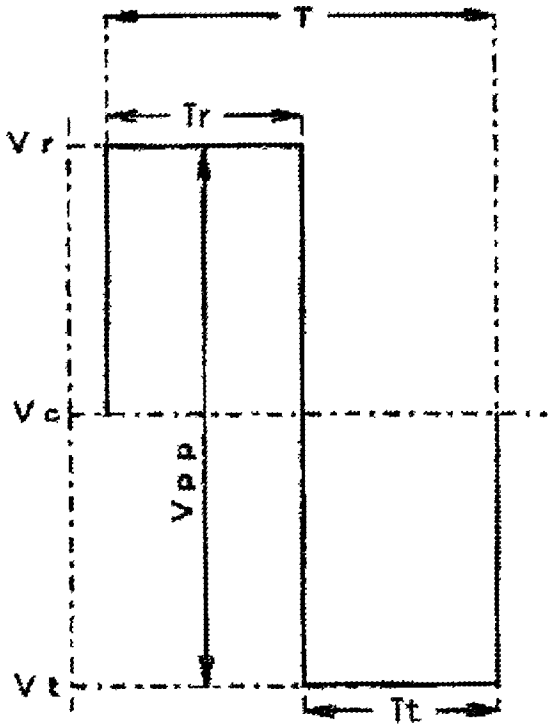
FIG. 9 is a graph illustrating the duty ratio in the secondary transfer bias illustrated in FIG. 7 according to an embodiment of the present invention.

FIG. 9 is a graph illustrating the duty ratio in the secondary transfer bias illustrated in FIG. 7.

In these figures, the center potential Vc is the center potential at the peak to peak value Vpp of the AC component (AC voltage) of the secondary transfer bias. The peak-to-peak value Vpp is the value from the reverse peak value Vr to the transfer peak value Vt.

Here, with respect to the secondary transfer bias formed of the superimposed voltages, within one cycle, the time, which is primarily intended to be used to move the toner on the surface of the intermediate transfer belt 31 inside the secondary transfer nip, from the belt side to the recording sheet surface in the nip, is defined as the transfer-side time Tt. That is, the time when the secondary transfer bias is on the transfer side (the negative polarity side in the present embodiment), relative to the time average value Vave (=the average potential), in one cycle T of the secondary transfer bias, when the secondary transfer bias moves the toner image from the intermediate transfer belt 31 to the recording sheet is defined as the transfer-side time Tt.

Further, the time (the rest of the cycle) different from the transfer-side time Tt is defined as the reverse-transfer-side time Tr. That is, the time when the secondary transfer bias is on the reverse transfer side (opposite to the transfer side; in the present embodiment, positive), relative to the time average value Vave, in one cycle T of the secondary transfer bias, is defined as the time at the reverse-transfer-side time Tr.

As illustrated in FIGS. 6 to 9, the reverse-transfer-side time Tr is the time when the value is on the side of the reverse peak value Vr in one cycle, with the time average value Vave being the border. Further, the ratio of the reverse-transfer-side time Tr within one cycle T is defined as the duty ratio of the secondary transfer bias formed of the superimposed voltages. That is, $(T-Tt)/T\times100$ [%] is defined as the duty. That is, the duty ratio is $Tr/(Tr+Tt)\times100$ [%], wherein Tt represents the time when the transfer bias is applied in a direction of transferring the toner of the toner image onto the recording sheet P, relative to the time average value Vave, and Tr represents the time when the transfer bias is applied in a reverse direction thereof. In the case of the waveforms illustrated in FIGS. 6-9, the duty ratio is 50 [%].

In the present embodiment, the property that the duty ratio exceeds 50 [%] is defined as a high duty ratio. The property that the duty ratio is less than 50 [%] is defined as the low duty ratio.

In order to move the toner from the surface of the intermediate transfer belt 31 to the surface of the recording sheet within the secondary transfer nip N by using the secondary transfer bias of the duty ratio=50 [%], the absolute value of the transfer peak value Vt needs to be higher than the absolute value of the reverse peak value Vr. If the absolute value of the transfer peak value Vt is too large, discharging is caused between the surface of the intermediate transfer belt 31 and the recording sheet (irregular sheet) P within the secondary transfer nip N. This discharging causes the toner particles to be reversely charged and significantly inhibits the secondary transfer of the toner particles, and, therefore, a large number of white points will be created in the image, resulting in a significant decline in image quality. Therefore, it is necessary to keep the absolute value of the transfer peak value Vt at a certain value.

On the other hand, if the absolute value of the reverse peak value Vr is too small, a sufficient amount of toner cannot be transferred to the recessed portions on the sheet surface of the recording sheet (irregular sheet) P. Specifically, if the absolute value of the reverse peak value Vr is too small, the toner particles once transferred from the belt surface to the recessed portions on the sheet surface of the recording sheet (irregular sheet) within the secondary transfer nip N, cannot be returned to the belt surface. Then, it will not be possible to have the toner particles returned from the recessed portions on the sheet surface to be hit against other toner particles on the intermediate transfer belt surface or toner particles adhering to the belt surface, so that the adhesion of the toner particles on the belt surface cannot be reduced. Simply vibrating the toner particles does not increase the number of toner particles transferring into the recessed portions on the sheet surface of the recording sheet (the irregular sheet) in accordance with the vibration, and, therefore, the amount of toner transferring to the recessed portions on the sheet surface will be insufficient.

One method of increasing the reverse peak value Vr is to increase the peak-to-peak value Vpp of the AC component. However, if the peak-to-peak value Vpp is increased in order to eliminate the insufficiency of the reverse peak value Vr, the transfer peak value Vt will be increased at the same time, thereby causing white points to be easily created by the discharging.

Another method to increase the reverse peak value Vr is to reduce the absolute value of the offset voltage Voff (the absolute value of the DC component). However, when the absolute value of the offset voltage Voff is reduced, the average potential Vave will also be reduced. Therefore, the toner cannot be electrostatically transferred with good transfer performance from the surface of the belt to the surface of the sheet in the secondary transfer nip N, and a secondary transfer failure may be caused.

Therefore, in order to transfer a sufficient amount of toner to the recessed portions on the sheet surface of the recording sheet (irregular sheet) P, it is preferable that the duty ratio is less than 50 [%].

Figure 10:
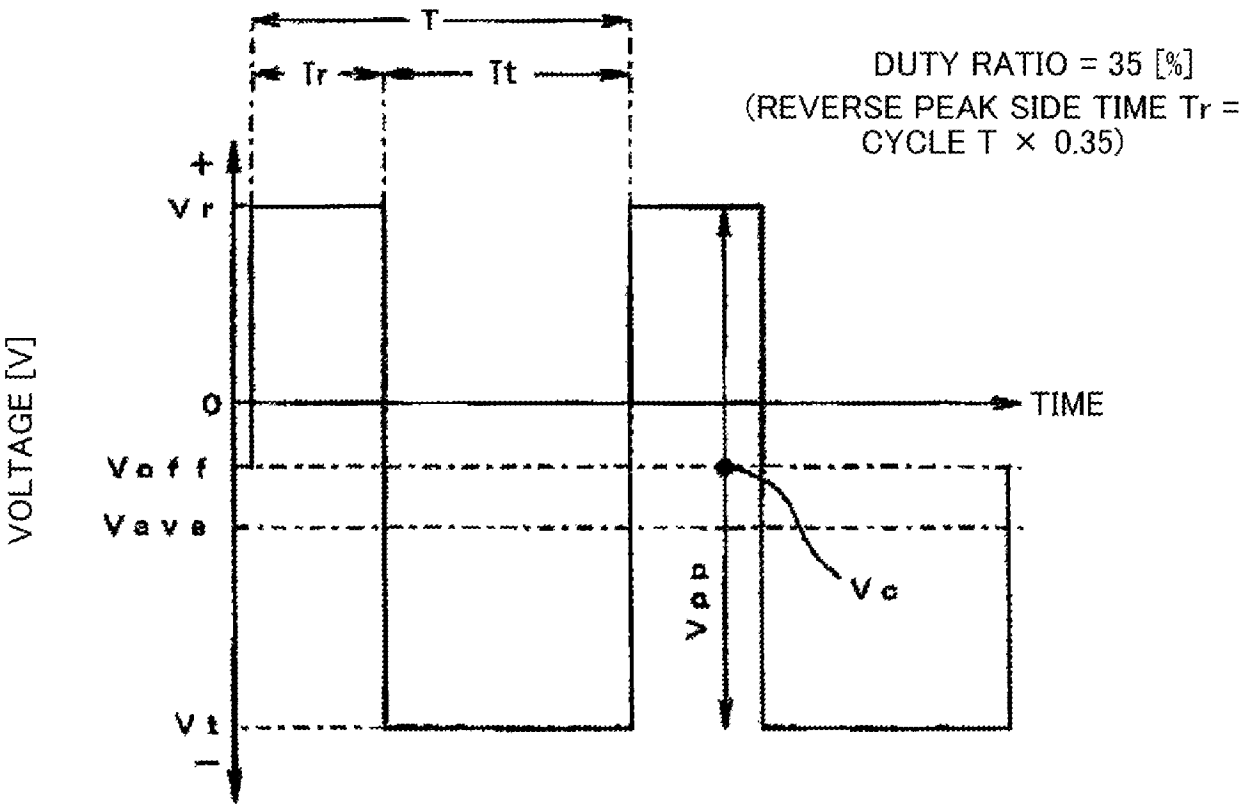
FIG. 10 is a graph illustrating an example of a waveform of secondary transfer bias with a duty ratio of 35 [%] that is less than 50 [%] according to an embodiment of the present invention.

FIG. 10 is a graph illustrating an example of a waveform of the secondary transfer bias with the duty ratio reduced to 35 [%] that is less than 50 [%].

The reverse peak value Vr of the secondary transfer bias illustrated in FIG. 10 is the same as the reverse peak value Vr of the secondary transfer bias illustrated in FIG. 7. The transfer peak value Vt of the secondary transfer bias illustrated in FIG. 10 is the same as the transfer peak value Vt of the secondary transfer bias illustrated in FIG. 7. The secondary transfer bias illustrated in FIG. 10 differs from the secondary transfer bias illustrated in FIG. 7 only in the reverse-transfer-side time Tr and transfer-side time Tt. In the secondary transfer bias illustrated in FIG. 7, the reverse-transfer-side time Tr and the transfer-side time Tt are the same, while in the secondary transfer bias illustrated in FIG. 10, the reverse-transfer-side time Tr is shorter than the transfer-side time Tt. More specifically, while the reverse-transfer-side time Tr of the secondary transfer bias illustrated in FIG. 7 is a time length of 50 [%] of the cycle T, the reverse-transfer-side time Tr of the secondary transfer bias illustrated in FIG. 10 is a time length of 35 [%] of the cycle (T). That is, the duty ratio of the secondary transfer bias illustrated in FIG. 10 is 35 [%].

As the secondary transfer bias, a waveform other than the square waveform illustrated in FIG. 10 may be used. The secondary transfer bias of a trapezoidal shaped waveform having a predetermined period of time for the voltage to shift from the reverse peak value Vr to the transfer peak value Vt and from the transfer peak value Vt to the reverse peak value Vr, may also be used. The secondary transfer bias in which a portion or all of the waveform is rounded, may also be used. The secondary transfer bias described below may also have a waveform other than a square waveform.

In the secondary transfer bias of the duty ratio=50 [%] illustrated in FIG. 7, as described above, the offset voltage Voff and the average potential Vave are the same value. In contrast, in the secondary transfer bias of the duty ratio 35 [%] illustrated in FIG. 10, the absolute value of the average potential Vave is greater than the absolute value of the offset voltage Voff. The peak to peak value Vpp is the same for the secondary transfer bias illustrated in FIG. 7 and the secondary transfer bias illustrated in FIG. 10. That is, by setting the duty ratio to less than 50 [%], the absolute value of the average potential Vave can be increased without changing the peak-to-peak value Vpp, the transfer peak value Vt, and the reverse peak value Vr, compared to the case where the duty ratio is 50 [%]. Therefore, when the duty ratio is 50 [%] or more, it is possible to prevent secondary transfer failures from occurring or white points from being created.

Accordingly, in the printer according to the embodiment, when the toner image is secondarily transferred to the recording sheet (irregular sheet) P, the printer is configured to use a secondary transfer bias in which the polarity is reversed within one cycle (T) and the duty ratio is less than 50 [%]. In such a configuration, compared to a configuration using a secondary transfer bias in which the duty ratio is 50 [%] or more, it is possible to prevent secondary transfer failures from occurring or white points from being created by the discharge.

Hereinafter, the property that the duty ratio is less than 50 [%] is referred to as a low duty ratio. In contrast, the property that the duty ratio exceeds 50 [%] is referred to as a high duty ratio.

Incidentally, the duty ratio is preferably set in the range of 8 [%] to 35 [%], and further preferably set in the range of 8 [%] to 17 [%]. However, if the duty ratio is a considerably small value, the ratio of the reverse-transfer-side time Tr in one cycle (T) will become considerably small.

Accordingly, there will be a risk that the toner particles in the recessed portions on the sheet surface of the recording sheet P (the irregular sheet) cannot be returned to the belt surface within the reverse-transfer-side time Tr. Accordingly, in this case, it is necessary to secure a sufficient reverse-transfer-side time Tr by making the frequency of the AC component relatively low and making the cycle (T) relatively long.

In the present printer, as the recording sheet P, a high smoothness sheet (coated sheet, etc.) and a low smoothness sheet (irregular sheet, etc.) having a lower surface smoothness than a high-smoothness sheet, are used. In the control unit 200, a high smoothness mode (first mode) for transferring the toner image to the high smoothness sheet and a low smoothness mode (second mode) for transferring the toner image to the low smoothness sheet are set (stored). The control unit 200 controls the secondary transfer power supply 39 to output a transfer bias in which the duty ratio is 50 [%] in the high smoothness mode and to output a transfer bias in which the duty ratio is less than 50 [%] in the low smoothness mode.

Next, an example of a nip pressure changing device for changing the nip pressure of the secondary transfer nip N will be described.

Figure 11:
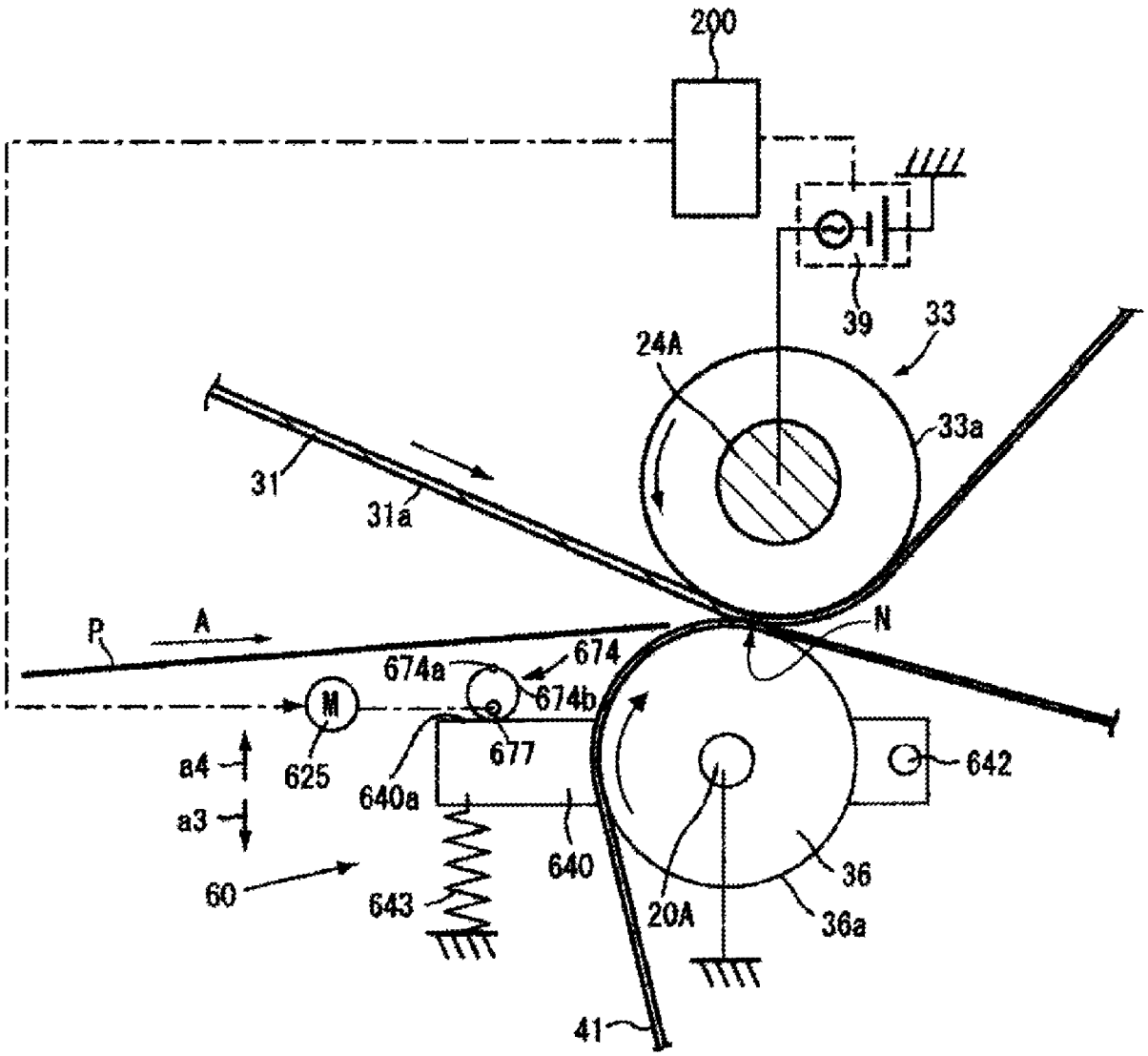
FIG. 11 is a diagram illustrating a nip pressure changing device in a state where the secondary transfer nip pressure is the highest according to an embodiment of the present invention.

The nip pressure changing device 60 as the nip pressure changing means illustrated in FIG. 11 changes the nip pressure of the secondary transfer nip N by moving the secondary transfer nip backing roller 36 that is the rotating member of at least one of the plurality of rotating members across which the sheet conveying belt 41 is stretched. The image forming apparatus includes a roller unit holding body 640 and a compression coil spring 643 as a pressing member for pressing the sheet conveying belt 41 toward the intermediate transfer belt 31 at the secondary transfer nip N. The nip pressure changing device 60 changes the pressure applied to the secondary transfer nip N by using a driving motor 625, an eccentric cam 674, and the like.

Further, when the nip pressure of the secondary transfer nip N is changed, the secondary transfer nip width W is also changed. The secondary transfer nip backing roller 36 and the secondary transfer back side roller 33 each have a cored bar and an elastic layer provided on the cored bar. As the pressure applied to the secondary transfer nip increases, the crush amount of the elastic layer of the secondary transfer nip backing roller 36 and the secondary transfer back side roller 33 increases, and the secondary transfer nip width W increases (expands).

The secondary transfer nip backing roller 36 is pressed against the intermediate transfer belt 31 which is wound around the secondary transfer back side roller 33. That is, the shaft 20A which rotatably supports the secondary transfer nip backing roller 36 is supported by the roller unit holding body 640. The roller unit holding body 640 has one end in the longitudinal direction swingably supported by the device fixing portion by the roller unit holding body 640. The compression coil spring 643 is mounted between the other end of the roller unit holding body 640 in the longitudinal direction and the device fixing portion. The roller unit holding body 640 is pressed to rotate in a clockwise direction in FIG. 11 about a support shaft 642 by the restoring force of the compression coil spring 643. Accordingly, the secondary transfer nip backing roller 36 is pressed toward the intermediate transfer belt 31 to apply pressure to the secondary transfer nip N.

Figure 12:
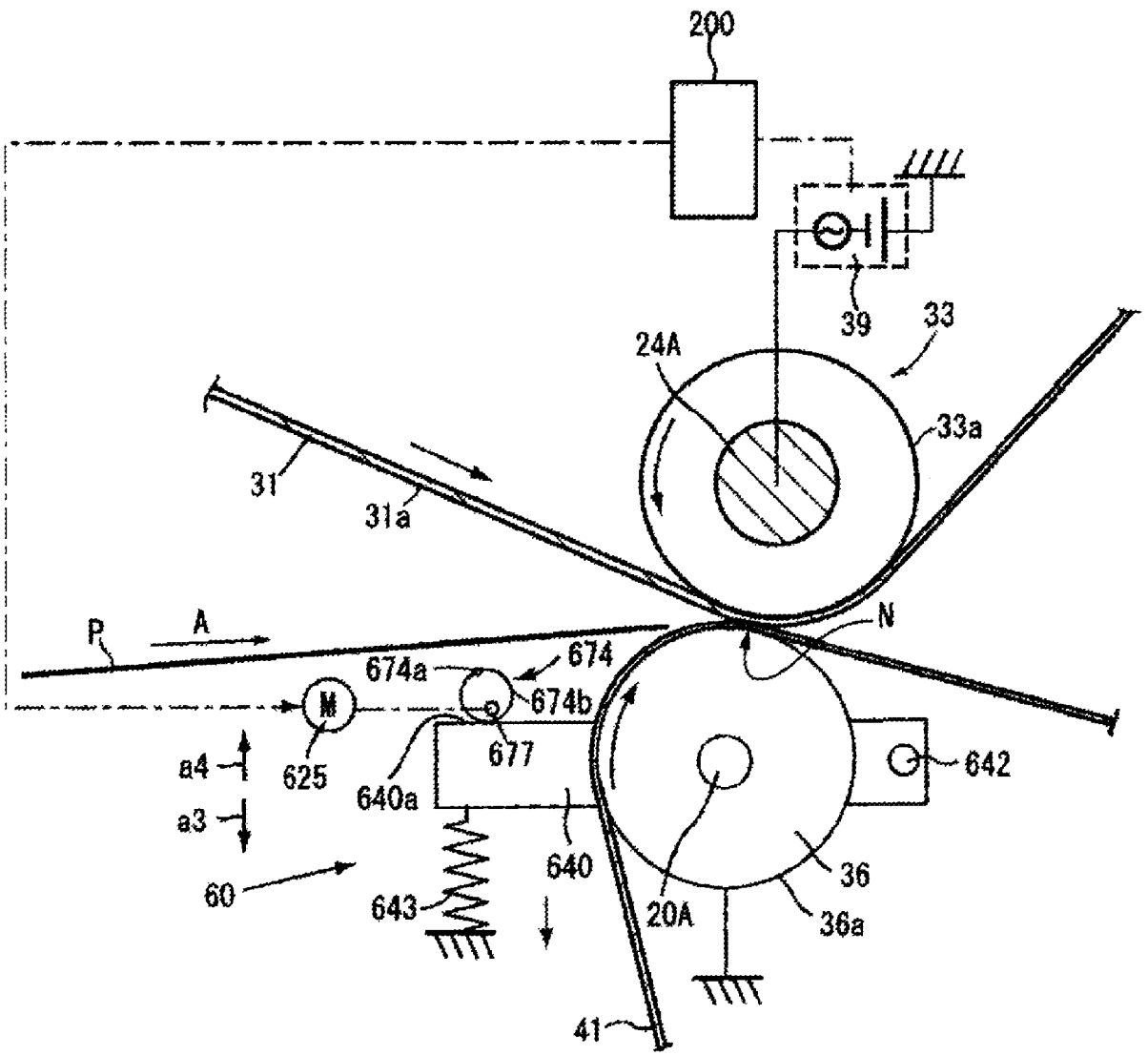
FIG. 12 is a diagram illustrating a nip pressure change device in a state where the secondary transfer nip pressure is reduced according to an embodiment of the present invention.

The nip pressure changing device 60 according to the present embodiment includes the eccentric cam 674 that contacts an upper portion 640*a* of the roller unit holding body 640 and displaces the position of the roller unit holding body 640, and the driving motor 625 as a driving means for rotationally driving the eccentric cam 674, as illustrated in FIGS. 11 and 12. The eccentric cam 674 is provided to rotate integrally with a driving shaft 677 rotated by the driving motor 625. The eccentric cam 674 has a cam surface with a maximum length from the rotation center thereof to a top dead center 674*a*, formed on an outer peripheral surface 674*b* of the eccentric cam 674. In the nip pressure changing device 60, the driving motor 625 is connected to the control unit 200 illustrated in FIG. 3 and the operation of the driving motor 625 is controlled by the control unit 200.

In the present embodiment, the driving motor 625 is connected to the control unit 200 via a signal line such that the driving of the driving motor 625 is controlled. Specifically, the control unit 200 controls the rotation of the driving motor 625 to rotate the eccentric cam 674 so that a point of 180 degrees with respect to the top dead center 674*a* is in contact with the upper portion 640*a* of the roller unit holding body 640, when the nip pressure is maximized, as illustrated in FIG. 11. Then, the nip pressure can be gradually reduced from the rotation position illustrated in FIG. 11 to the rotation position where the top dead center 674*a* contacts the upper portion 640*a* of the roller unit holding body 640 by rotating the eccentric cam 674 as illustrated in FIG. 12.

In FIGS. 11 and 12, an arrow a3 indicates the direction of suppressing the spring force applied to the secondary transfer nip N, and an arrow a4 indicates the direction of releasing the suppressing with respect to the spring force applied to the secondary transfer nip N. That is, the suppressing direction a3 of the spring force applied to the secondary transfer nip N is a direction of pushing down the other end side of the roller unit holding body 640, and the suppressing release direction of the spring force applied to the secondary transfer nip N is a direction of lifting the other end side of the roller unit holding body 640.

Further, the configuration of the nip pressure changing device 60 is not particularly limited to that according to the present embodiment, as long as the nip pressure of the secondary transfer nip N can be changed by the control by the control unit 200.

Next, the control contents by the control unit 200 will be described.

Figure 13:
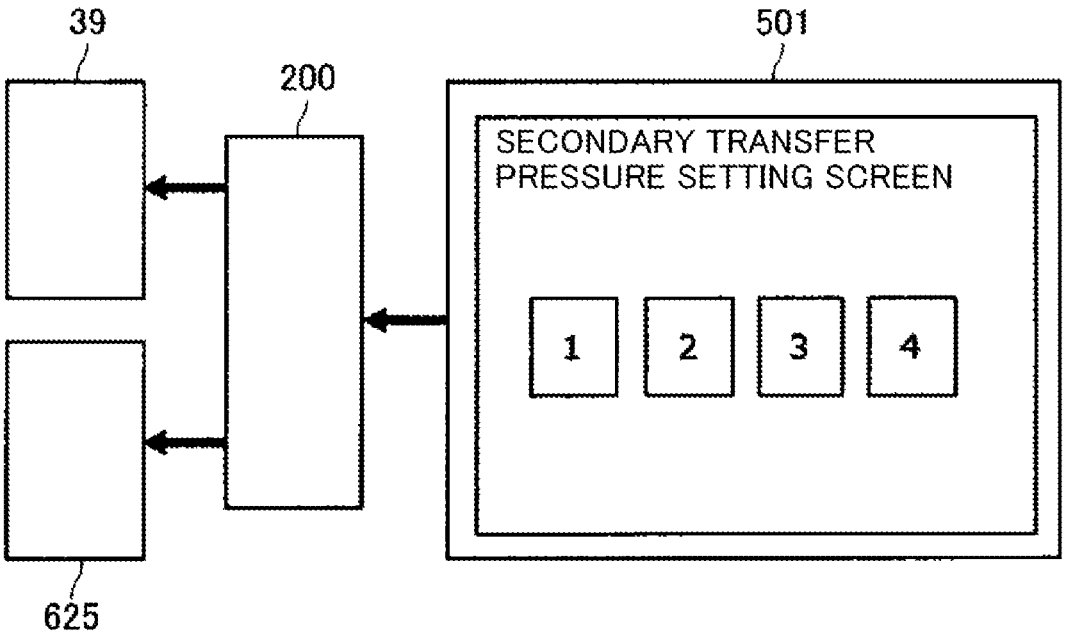
FIG. 13 is a block diagram illustrating an example of a control system including an input operation unit of the printer according to an embodiment of the present invention.

FIG. 13 is a block diagram illustrating an example of a control system including an input operation unit 501 as an input receiving unit.

As illustrated in FIG. 13, the input operation unit 501 is configured by, for example, a touch panel, and functions as an input receiving unit that receives the user operation input for selecting the nip pressure (the pressure settings 1 to 4) of the secondary transfer nip N. Specifically, as illustrated in FIG. 13, a secondary transfer pressure setting screen including four selection buttons corresponding to the pressure settings 1 to 4 is displayed on the input operation unit 501. Here, it is assumed that the pressure setting 1, the pressure setting 2, the pressure setting 3, and the pressure setting 4 are arranged in an ascending order according to the magnitude of the nip pressure of the secondary transfer nip N, with the pressure setting 4 being the highest pressure.

The control unit 200 previously stores information on the rotation position of the eccentric cam 674 corresponding to the pressure settings 1 to 4, respectively. When the user operates the input operation unit 501 and selects any of the pressure settings 1 to 4, the control unit 200 controls the driving motor 625 of the nip pressure changing device 60 to rotate the eccentric cam 674 to a corresponding rotational position. Accordingly, the other end side of the roller unit holding body 640 moves in the suppressing direction a3 of the spring force or the suppressing release direction a4 of the spring force, and the nip pressure of the secondary transfer nip N is changed to the pressure of the pressure settings 1 to 4 selected by the user. As described above, the user can change the nip pressure of the secondary transfer nip N by operating the input operation unit 501.

Figure 14:
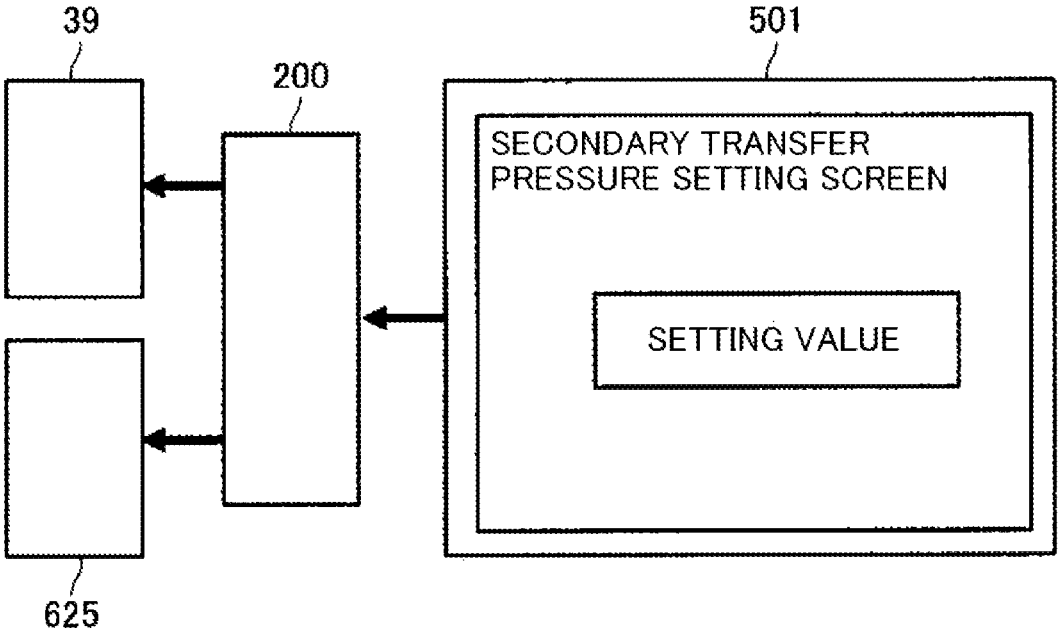
FIG. 14 is a block diagram illustrating another example of a control system including the input operation unit according to an embodiment of the present invention.

FIG. 14 is a block diagram illustrating another example of a control system including the input operation unit 501.

The example of FIG. 13 uses a discrete setting method in which the nip pressure of the secondary transfer nip is selected from the four steps of the pressure settings 1 to 4. In contrast, the example of FIG. 14 uses a method in which nip pressure can be set in a smaller number of steps (for example, the number of motor steps when the driving motor 625 is a stepping motor). Specifically, as illustrated in FIG. 14, a secondary transfer pressure setting screen including a setting value input field for inputting a set value is displayed on the input operation unit 501, and the user operates the input operation unit 501 to input a pressure value in the setting value input field. Thus, the control unit 200 controls the driving motor 625 of the nip pressure changing device 60 so that the eccentric cam 674 rotates to a rotational position of the eccentric cam 674 corresponding to the input pressure value.

When the toner is transferred to a recording sheet (a low smoothness sheet) having a low smoothness such as an irregular sheet, the toner transfer rate to the low smoothness sheet (particularly the toner transfer rate to the recessed portions of the sheet surface) may be improved by increasing the nip pressure of the secondary transfer nip. This is because the surface shape of the intermediate transfer belt 31 will be deformed in accordance with the surface irregularities of the low smoothness sheet by increasing the transfer nip pressure, and as a result, the adhesion between the intermediate transfer belt 31 and the low smoothness sheet is increased, so that a high toner transfer rate can be achieved even with respect to the recessed portions. Accordingly, for example, when a user views the image formed on the recording sheet P and wishes to improve the toner transfer rate with respect to the recessed portions, the user operates the input operation unit 501 to increase the nip pressure of the secondary transfer nip N in the secondary transfer pressure setting screen on the input operation unit 501.

However, as a result of studies by the inventors of the present invention, it has been found that when the nip pressure of the secondary transfer nip N is changed, it is difficult to obtain good transfer performance in both a solid image and a halftone image if the conditions of the secondary transfer bias remain constant. Specifically, when a transfer bias condition in which good transfer performance is obtained in both a solid image and a halftone image at a certain transfer nip pressure (for example, pressure setting 1) is set, and if the transfer nip pressure is raised with this transfer bias condition, the transfer performance of a halftone image will be degraded.

Figure 15:
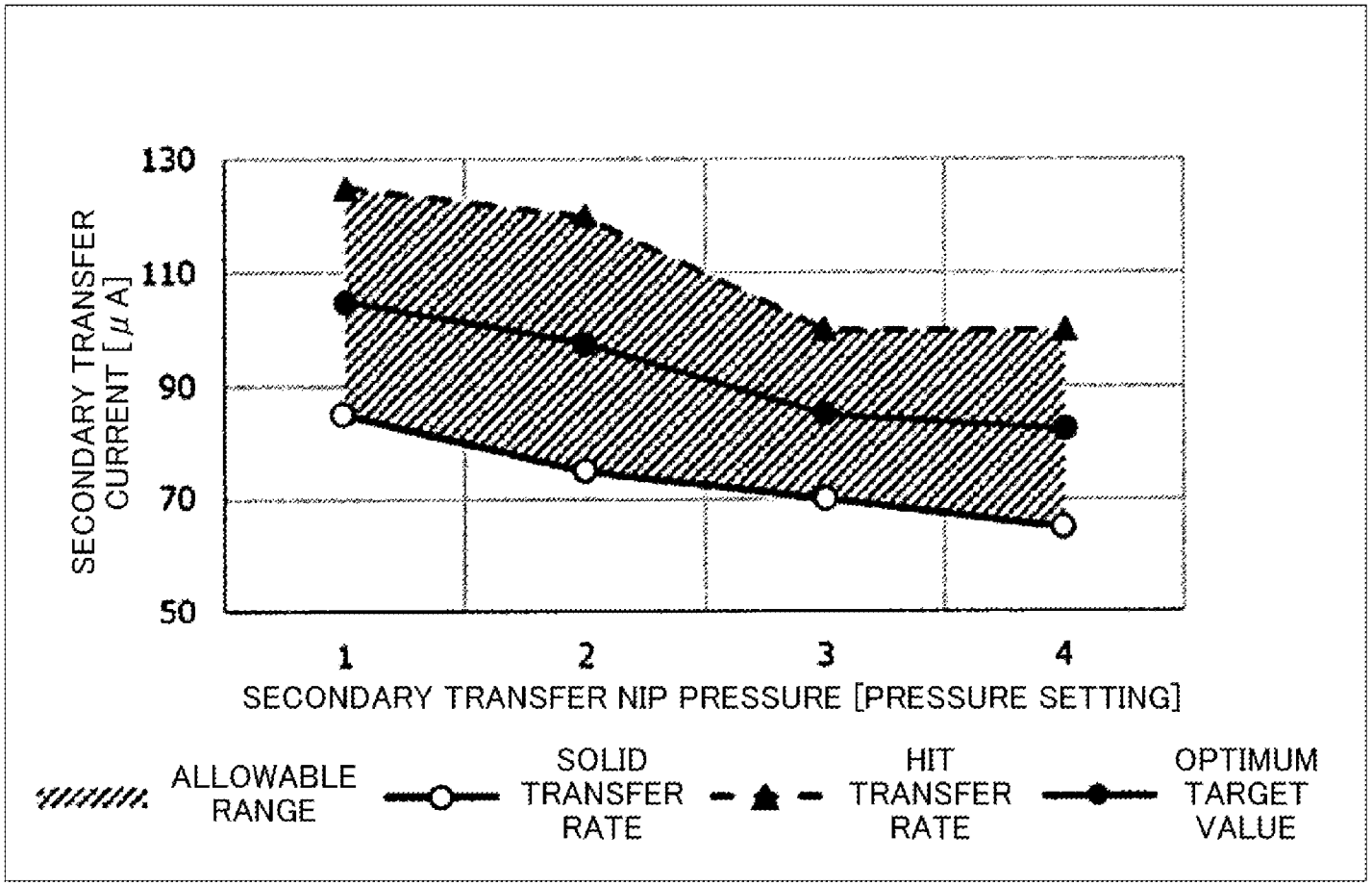
FIG. 15 is a graph illustrating the relationship between the nip pressure of the secondary transfer nip and the optimum target value of the secondary transfer current according to an embodiment of the present invention.

FIG. 15 is a graph illustrating a relationship between the nip pressure of the secondary transfer nip N and the optimum target value of the secondary transfer current flowing through the secondary transfer nip N.

Generally, if the toner transfer rate of a solid image (maximum image density) or a halftone image (image density is, for example, 30% to 70%) is 80% or more, the image quality is acceptable. Hereinafter, the toner transfer rate of the solid image is referred to as the "solid transfer rate", and the toner transfer rate of the halftone image is referred to as the "HT transfer rate."

Here, in the secondary transfer bias condition of the present embodiment, with respect to a solid image, if the secondary transfer current flowing through the secondary transfer nip N is too low, the secondary transfer current amount is insufficient for the toner amount per unit area, and the toner transfer rate cannot be maintained at 80% or more. In the graph of FIG. 15, the lower limit value of the secondary transfer current that can maintain the solid transfer rate at 80% or more is plotted with a blanked circle. On the other hand, in the halftone image, with respect to a halftone image, if the secondary transfer current flowing through the secondary transfer nip N is too high, the secondary transfer current amount will be excessive relative to the toner amount per unit area, and thus the toner transfer rate cannot be maintained at 80% or more. In the graph of FIG. 15, an upper limit value of the secondary transfer current that can maintain the HT transfer rate at 80% or more is plotted with a black-filled triangle.

Therefore, in order to set the toner transfer rate to 80% or more for both the solid image and the halftone image, it is necessary to set the condition of the secondary transfer bias such that the secondary transfer current falls between the upper limit value according to the HT transfer rate and the lower limit value according to the solid transfer rate. The value of the secondary transfer current flowing through the secondary transfer nip N is likely to vary according to various factors even without changing the condition of the secondary transfer bias, and, therefore, the optimum target value of the secondary transfer current is preferably set to be an intermediate value between the upper limit value according to the HT transfer rate and the lower limit value according to the solid transfer rate. For example, in the graph of FIG. 15, in the case of the pressure setting 1, the lower limit value is approximately 85 ρA and the upper limit value is approximately 125 ρA, and, therefore, the optimum target value of the secondary transfer current (plotted with a black-filled circle) is set to (85+125)/2=105 ρA.

At this time, the lower limit value of the secondary transfer current that can maintain the solid transfer rate at 80% or more and the upper limit value of the secondary transfer current that can maintain the HT transfer rate at 80% or more (the lower limit value and the upper limit value of the allowable range of the secondary transfer current) change according to the difference in nip pressure of the secondary transfer nip N. Specifically, as the nip pressure of the secondary transfer nip N increases, both the lower limit value and the upper limit value of the allowable range of the secondary transfer current tend to decrease, as illustrated in FIG. 15. This is because, as described above, the adhesion between the intermediate transfer belt 31 and the recording sheet P is improved by increasing the transfer nip pressure, and the toner transfer rate is improved.

That is, as a result of the increase in the transfer nip pressure and the increase in the toner transfer rate, in the solid image, the necessary secondary transfer current amount is reduced, and, therefore, the lower limit value of the secondary transfer current that can maintain the solid transfer rate at 80% or more is lowered. On the other hand, in the halftone image, as a result of the increase in the transfer nip pressure and the increase in the toner transfer rate, the secondary transfer current amount tends to be excessive, so that the upper limit value of the secondary transfer current that can maintain the HT transfer rate at 80% or more is lowered.

Here, for example, it is considered that the nip pressure of the secondary transfer nip N is changed from the pressure setting 1 to the pressure setting 3 or 4. In this case, as illustrated in FIG. 15, the value 105 μA of the secondary transfer current that had been the optimum target value of the pressure setting 1 exceeds the upper limit value (approximately 100 μA) in the pressure setting 3 or 4. Therefore, if the transfer nip pressure is changed to the pressure setting 3 or the pressure setting 4 while the condition of the secondary transfer bias is maintained such that the secondary transfer current is set to the optimum target value of the pressure setting 1, the toner transfer rate of the halftone image becomes less than 80%, resulting in the degrading of transfer performance.

Therefore, in the embodiment, the control unit 200 performs control for adjusting the DC component of the secondary transfer bias in accordance with the nip pressure of the changed secondary transfer nip N. Specifically, when the user operates the input operation unit 501 to change the pressure setting, the control unit 200 controls the nip pressure changing device 60 to change the nip pressure of the secondary transfer nip N, and controls the secondary transfer power supply 39 to adjust the DC component of the secondary transfer bias.

In the present embodiment, the correction amount (hereinafter, referred to as the "bias correction amount") of the DC component of the secondary transfer bias corresponding to each of the pressure settings 1 to 4, is stored in the control unit 200 in advance. The bias correction amount according to the embodiment represents the ratio of the DC component value of the secondary transfer bias in which the secondary transfer current is the target optimum value in each of the pressure settings 1 to 4, with respect to the DC component value of the secondary transfer bias in which the secondary transfer current is the target optimum value in the pressure setting 1. For example, the bias correction amount of the pressure setting 1 is 100%, the bias correction amount of the pressure setting 2 is 95%, the bias correction amount of the pressure setting 3 is 90%, and the bias correction amount of the pressure setting 4 is 85%.

When the user operates the input operation unit 501 and selects any one of the pressure settings 1 to 4, the control unit 200 outputs, to the DC output control unit 111 of the secondary transfer power supply 39, a DC_PWM signal corrected with a bias correction amount corresponding to the selected pressure setting. Therefore, the DC power supply 110 of the secondary transfer power supply 39 outputs a DC voltage corrected with a bias correction amount corresponding to the selected pressure setting. As a result, the offset voltage Voff of the secondary transfer bias is adjusted, and the secondary transfer current flowing to the secondary transfer nip N becomes the optimum target value corresponding to the selected pressure setting.

Therefore, it is possible to prevent the excess of the secondary transfer current with respect to the halftone image, and, therefore, it is possible to prevent the decline in the toner transfer rate of the halftone image that may occur when the nip pressure of the secondary transfer nip N is changed while the condition (the DC component) of the secondary transfer bias is constant. At this time, the secondary transfer current decreases, and, therefore, the toner transfer rate of the solid image may be affected, but the toner transfer rate of the solid image does not deviate from the allowable range (the solid transfer rate is 80% or more).

As described above, according to the present embodiment, even when the nip pressure of the secondary transfer nip N is changed, a high toner transfer rate (80% or more) can be obtained in both the solid image and the halftone image, and thus good transfer performance can be obtained.

As described above, as the nip pressure of the secondary transfer nip N increases, the upper limit value (the upper limit value of the allowable range of the secondary transfer current) of the secondary transfer current according to the HT transfer rate tends to decrease, but the degree of this tendency (the amount of decrease of the upper limit value) varies depending on the type of the recording sheet P. For example, the larger the basis weight of the recording sheet P having the same surface condition, the greater the degree of reduction of the upper limit value according to the HT transfer rate against the increase in the nip pressure of the secondary transfer nip N. Therefore, the control unit 200 preferably changes the bias correction amount (adjustment amount) of the DC component of the secondary transfer bias according to the difference in the type of recording sheet P on which the toner on the intermediate transfer belt 31 is transferred.

Figure 16:
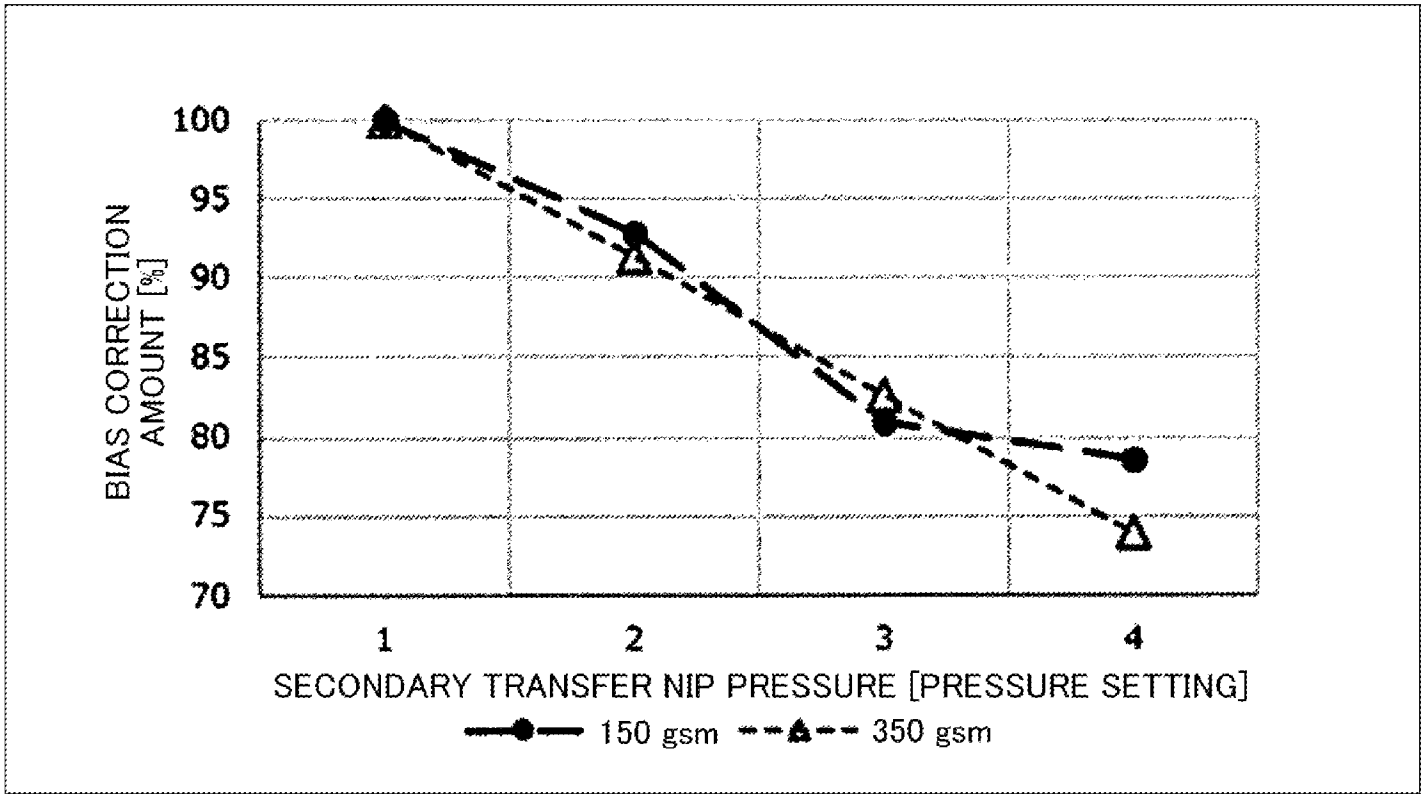
FIG. 16 is a graph illustrating the relationship between the nip pressure of the secondary transfer nip and the optimum value of the bias correction amount for two recording sheets according to an embodiment of the present invention.

FIG. 16 is a graph illustrating a relationship between a nip pressure of the secondary transfer nip N and an optimum value of a bias correction amount for two types of recording sheets.

As illustrated in the graph of FIG. 16, in the case of a recording sheet having a basis weight of 150 gsm and in the case of a recording sheet having a basis weight of 350 gsm, the optimum bias correction amount (the optimum target value of the secondary transfer current) at each of the pressure settings 1 to 4 varies. Accordingly, the control unit 200 preferably varies the bias correction amount of the DC component of the secondary transfer bias according to a difference in the basis weight or the sheet thickness of the recording sheet P on which the toner on the intermediate transfer belt 31 is transferred.

The basis weight or sheet thickness of the recording sheet P can be determined by, for example, a method in which the basis weight or the sheet thickness of the recording sheet P is determined by using a detection means incorporated into the recording sheet conveying path in the printer. Further, a method of determining the basis weight or the sheet thickness of the recording sheet P by using the detecting means external to the printer is provided. Further, a method of determining the basis weight or sheet thickness of the recording sheet P based on the brand of the recording sheet P entered by operating the input operation unit 501 of the printer or the like is provided. The detecting means is not particularly limited, and any type of sensor may be used as the detecting means, such as a manual type or an automatic type.

Here, the type of the recording sheet P is distinguished by a difference in the basis weight or the sheet thickness, but the type of the recording sheet P may be distinguished by the brand of the recording sheet, for example. Differences in the brands in the recording sheets will be a combination of factors such as surface conditions, sheet thickness, material, and electrical characteristics, and the degree of the above-mentioned tendency varies. Accordingly, the control unit 200 preferably changes the bias correction amount (adjustment amount) of the DC component of the secondary transfer bias according to a difference in the brand of the recording sheet P on which the toner on the intermediate transfer belt 31 is transferred. The bias correction amount for each pressure setting for each brand of recording sheet P may also affect the individual variation of the printer, and, therefore, it is better to determine the bias correction amount with respect to each pressure setting, for each brand of recording sheet P and for each individual printer. A multi-dimensional approximation formula may be used.

As described above, as the nip pressure of the secondary transfer nip N increases, the upper limit value (the upper limit value of the allowable range of the secondary transfer current) of the secondary transfer current according to the HT transfer rate tends to decrease, but the degree of this tendency (the amount of decrease of the upper limit value) varies depending on the operation environment of the printer. For example, depending on the temperature and humidity environment of the present printer, the degree of reduction of the upper limit value according to the HT transfer rate with respect to the increase in the nip pressure of the secondary transfer nip N varies. Accordingly, it is preferable that the control unit 200 changes the bias correction amount (adjustment amount) of the DC component of the secondary transfer bias depending on the operation environment of the present printer.

Figure 17:
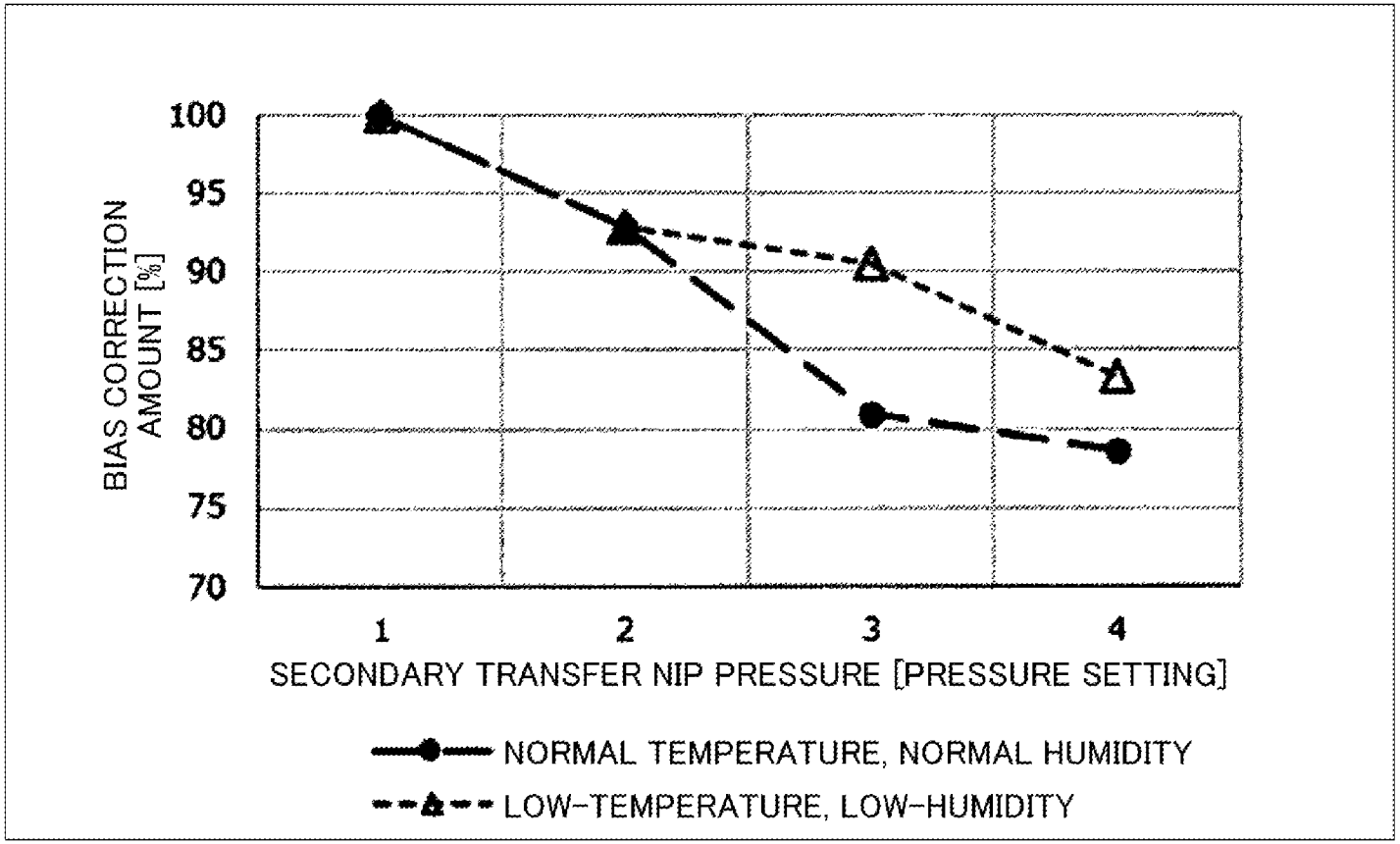
FIG. 17 is a graph illustrating a relationship between a nip pressure of the secondary transfer nip and an optimum value of a bias correction amount for two types of operation environments according to an embodiment of the present invention.

FIG. 17 is a graph illustrating a relationship between a nip pressure of the secondary transfer nip N and an optimum value of a bias correction amount for the two types of operation environments.

As illustrated in the graph of FIG. 17, the optimum bias correction amount for each of the pressure settings 1 to 4 will change in the case where the operation environment is a normal temperature, normal humidity environment (23° C., 50%) and in the case were the operation environment is a low-temperature, low-humidity environment (10° C., 15%). In the low-temperature, low-humidity environment, the charge amount of the toner is high, and, therefore, the shortage of the secondary transfer current in the solid image is reduced, the lower limit value of the secondary transfer current according to the solid transfer rate is increased, the excess of the secondary transfer current in the halftone image is reduced, and the upper limit value of the secondary transfer current according to the HT transfer rate is also increased. Accordingly, the absolute value of the optimum target value of the secondary transfer current in each of the pressure settings 1 to 4 is higher in the low-temperature, low-humidity environment than in the normal temperature, normal humidity environment. However, the amount of decrease (value of decrease) of the optimum target value of the secondary transfer according to the increase in the nip pressure of the secondary transfer nip, is approximately the same in both the normal temperature, normal humidity environment and the low-temperature, low-humidity environment.

However, the bias correction amount is a parameter represented by the ratio of the optimum target value of the secondary transfer current of each of the pressure settings 1 to 4 to the optimum target value of the secondary transfer current of the pressure setting 1. The bias correction amount is such a ratio, and, therefore, even though the amount of decrease (value of decrease) of the optimum target value of the secondary transfer according to the increase in the nip pressure of the secondary transfer nip, is approximately the same in both the normal temperature, normal humidity environment and the low-temperature, low-humidity environment, the amount of decrease (ratio of decrease) of the bias correction amount differs between the normal temperature, normal humidity environment and the low-temperature, low-humidity environment. As a result, there is a difference in the bias correction amount between the normal temperature, normal humidity environment and the low-temperature, low-humidity environment, as illustrated in the graph of FIG. 17. Note that in the graph of FIG. 17, the bias correction amount of the pressure setting 2 does not differ between the normal temperature, normal humidity environment and the low-temperature, low-humidity environment, but it is considered that this is due to the variation in the measurement of the optimum target value of the secondary transfer current.

Therefore, it is preferable that the control unit 200 changes the bias correction amount (adjustment amount) of the DC component of the secondary transfer bias, according to the difference in the temperature-humidity environment of the present printer. A known temperature sensor, humidity sensor, and temperature and humidity sensor may be used as an environment information acquiring means for acquiring the information of the temperature and humidity environment (the operation environment information) of the image forming apparatus.

In the present embodiment, as described above, a secondary transfer bias in which the duty ratio is 50 [%] is used in the high smoothness mode for transferring the toner image to a high smoothness sheet, and a secondary transfer bias in which the duty ratio is less than 50 [%] is used in the low smoothness mode. The larger the nip pressure of the secondary transfer nip N, the lower the upper limit value (the upper limit value of the allowable range of the secondary transfer current) of the secondary transfer current according to the HT transfer rate tends to be, but the degree of this tendency varies according to the difference in the duty ratio. Accordingly, the control unit 200 preferably changes the bias correction amount (adjustment amount) of the DC component of the secondary transfer bias according to the difference in the duty ratio of the secondary transfer bias.

Figure 18:
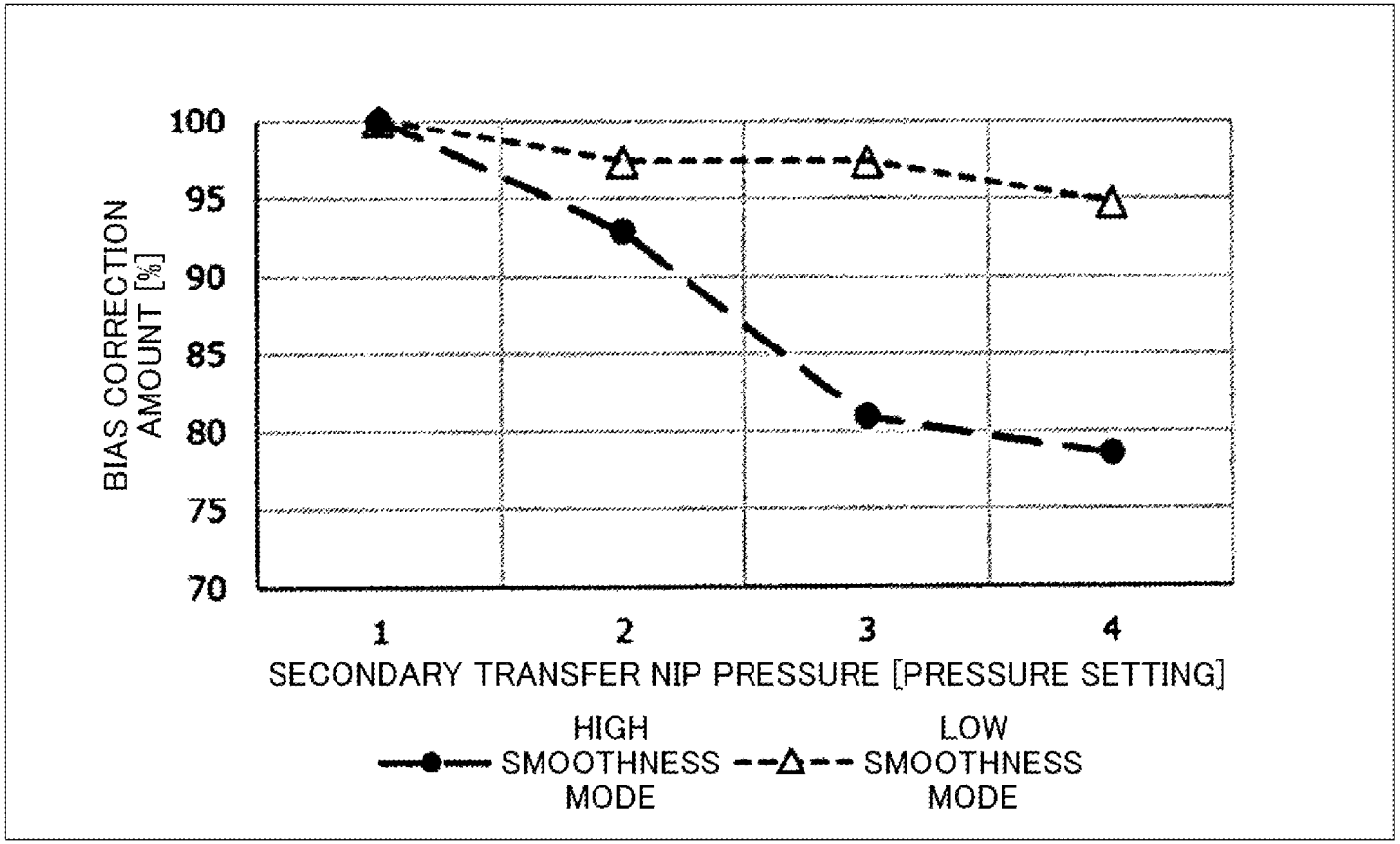
FIG. 18 is a graph illustrating a relationship between a nip pressure of a secondary transfer nip and an optimum value of a bias correction amount for a high smoothness mode and a low smoothness mode according to an embodiment of the present invention.

FIG. 18 is a graph illustrating a relationship between a nip pressure of the secondary transfer nip N and an optimum value of a bias correction amount for the high smoothness mode and low smoothness mode.

As illustrated in the graph of FIG. 18, the optimum bias correction amount (the optimum target value of the secondary transfer current) at each of the pressure settings 1 to 4 varies between the high smoothness mode in which the duty ratio is 50 [%] and the low smoothness mode in which the duty ratio is less than 50 [%].

In the low smoothness mode, the duty ratio is set to be low, which increases the transfer-side time Tt within one cycle T, thereby increasing the toner transfer rate at the recessed portions on the sheet surface of the recording sheet P. As described above, the toner transfer rate at the recessed portions on the sheet surface has already been increased, so as a result, it is difficult to further increase the toner transfer rate at the recessed portions on the sheet surface even if the nip pressure of the secondary transfer nip N is increased. Therefore, even when the pressure settings 1 to 4 are changed, the optimum target value of the secondary transfer current hardly changes, and as illustrated in the graph of FIG. 18, the optimum value of the bias correction amount hardly changes. This tendency is particularly significant on paper with very rough irregularities, such as Resac 66 215 kg.

On the other hand, in the high smoothness mode, the transfer-side time Tt is shorter in one cycle T than in the low smoothness mode, and the effect of improving the toner transfer rate of the recessed portions on the sheet surface of the recording sheet P according to the low duty ratio, is not obtained. Therefore, the effect of increasing the toner transfer rate of the recessed portions on the sheet surface by increasing the nip pressure of the secondary transfer nip N can be obtained, and, therefore, the optimum target value of the secondary transfer current changes by changing between the pressure settings 1 to 4.

Accordingly, the control unit 200 preferably changes the bias correction amount (adjustment amount) of the DC component of the secondary transfer bias according to a difference in the duty ratio of the secondary transfer bias (a difference in the transfer mode).

In the present printer, a test image is formed in a non-image area or the like between images (between pages, between sheets) for the purpose of image quality adjustment, and various image forming conditions are adjusted on the basis of a detection result with respect to the test image obtained by a detection means such as a density sensor similar to the density sensor 40. The test image at this time may be formed on the recording sheet and detected by the detecting means, but this is undesirable because the recording sheet will be consumed. Further, the test image on the intermediate transfer belt 31 may be detected by the detection means, but in this case, the effect of the secondary transfer cannot be detected, and, therefore, the secondary transfer conditions cannot be adjusted.

Therefore, according to the present exemplary embodiment, in the secondary transfer nip, the test image on the intermediate transfer belt 31 is transferred onto the sheet conveying belt 41 instead of the recording sheet P, and the test image on the sheet conveying belt 41 is detected by the detecting means. In this case, the secondary transfer conditions can be adjusted without consuming the recording sheet.

Figure 19:
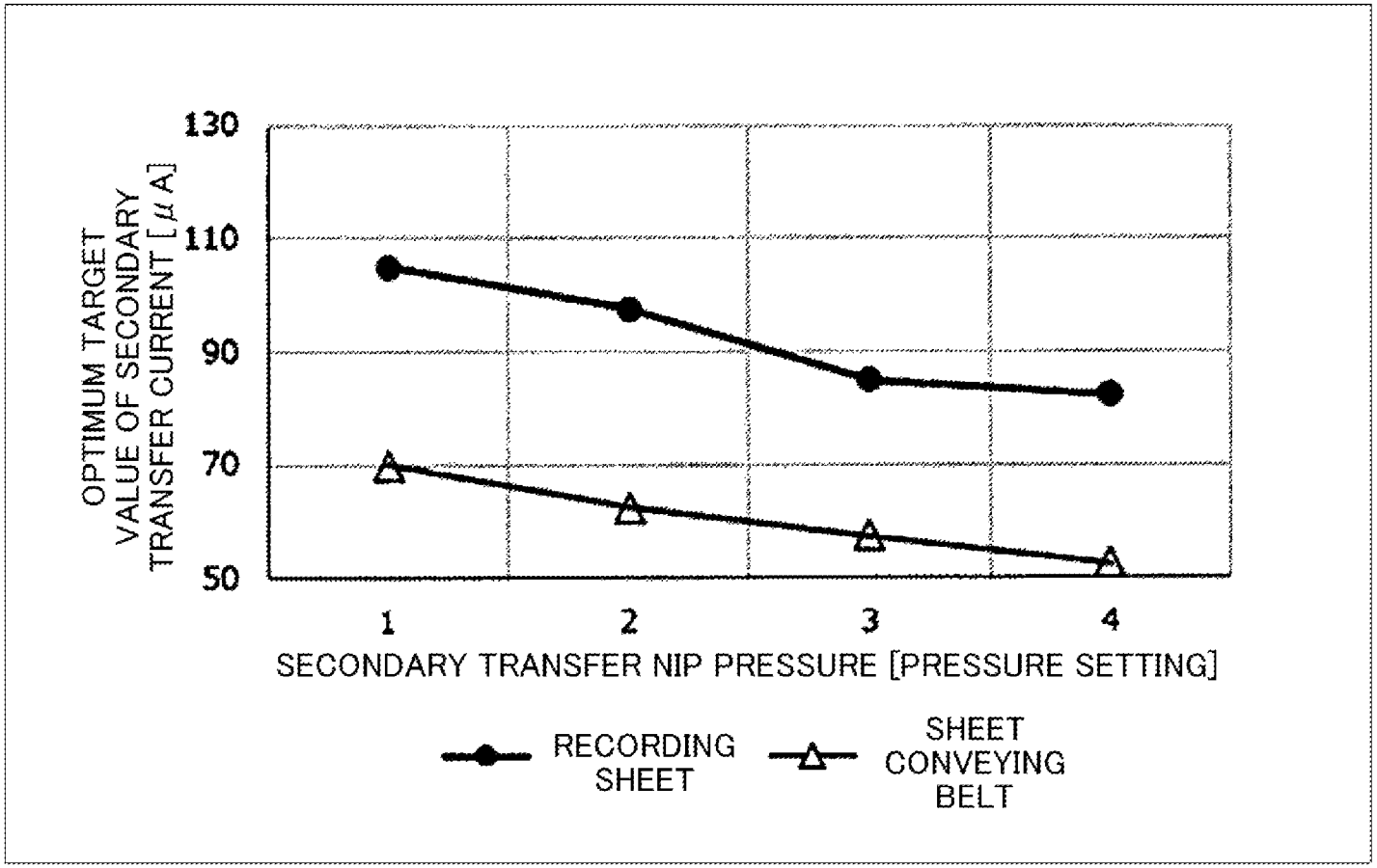
FIG. 19 is a graph illustrating a relationship between a nip pressure of the secondary transfer nip and an optimum target value of the secondary transfer current with regard to a time when the toner on the intermediate transfer belt is transferred onto the recording sheet (at the time of sheet transfer) and a time when the toner is transferred onto the sheet conveying belt (at the time of belt transfer) according to an embodiment of the present invention.

FIG. 19 is a graph illustrating a relationship between a nip pressure of the secondary transfer nip N and an optimum target value of the secondary transfer current with regard to a time when the toner on the intermediate transfer belt 31 is transferred onto the recording sheet P (at the time of sheet transfer) and a time when the toner is transferred onto the sheet conveying belt 41 (at the time of belt transfer).

As illustrated in the graph illustrated in FIG. 19, in both at the time of sheet transfer and at the time of belt transfer, the optimum target value of the secondary transfer current tends to decrease as the nip pressure of the secondary transfer nip N increases, but the optimum target value of the secondary transfer current is smaller at the time of belt transfer than at the time of sheet transfer.

The image quality adjustment according to the embodiment is performed on the assumption that the test image is transferred from the intermediate transfer belt 31 to the sheet conveying belt 41 in the normal setting (the pressure setting 1) in which the nip pressure of the secondary transfer nip N is not increased. Accordingly, in a continuous image forming operation in which the nip pressure of the secondary transfer nip N is set to the pressure 1, the DC component of the secondary transfer bias is changed so that the secondary transfer current becomes the optimum target value at the time of belt transfer during the period when the sheets pass through the secondary transfer nip, and the transfer of the test image is performed. Further, within that period, the DC component of the secondary transfer bias is changed back to the former value.

Meanwhile, when a continuous image forming operation is performed at the setting in which the nip pressure of the secondary transfer nip N is increased, the nip pressure of the secondary transfer nip N remains increased even between the sheets during the continuous image forming operation. This is because, the period during which the portion between sheets pass through the secondary transfer nip N is short, and, therefore, the operation of changing the nip pressure of the secondary transfer nip N, secondarily transferring the test image, and then changing back the nip pressure again, cannot be completed within this period. Therefore, transfer of the test image from the intermediate transfer belt 31 to the sheet conveying belt 41 will be performed in a state in which the nip pressure of the secondary transfer nip N is increased.

In the present embodiment, even in such a case, the DC component of the secondary transfer bias is adjusted so that the optimum secondary transfer current flows when the nip pressure of the secondary transfer nip N is increased. However, the adjustment amount (bias correction amount) is optimum at the time of sheet transfer, but is not optimum at the time of belt transfer.

Figure 20:
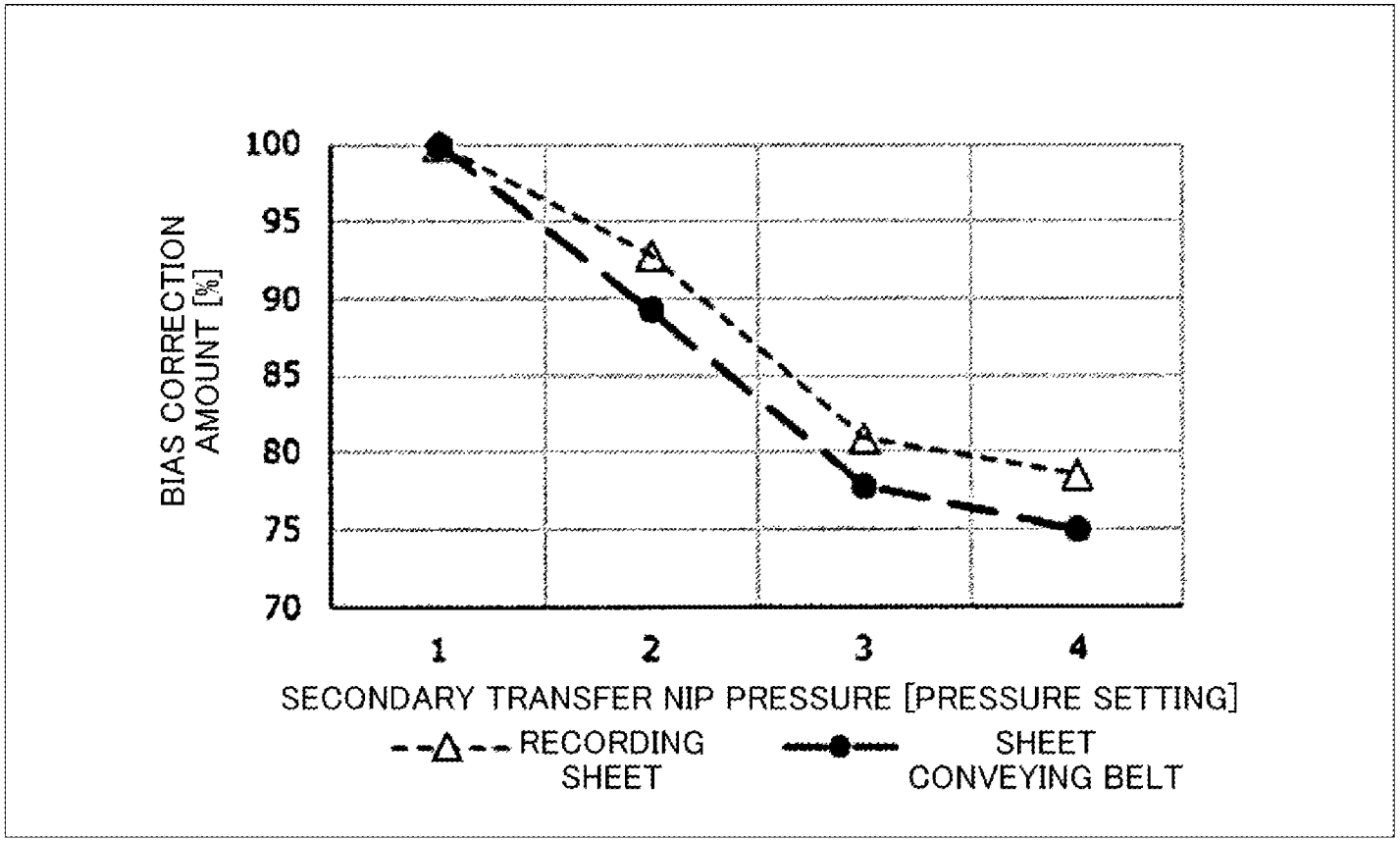
FIG. 20 is a graph illustrating the relationship between the nip pressure of the secondary transfer nip and the optimum value of the bias correction amount for the sheet transfer time and the belt transfer time according to an embodiment of the present invention.

FIG. 20 is a graph illustrating a relationship between a nip pressure of the secondary transfer nip N and an optimum value of a bias correction amount for the time of sheet transfer and the time of belt transfer.

As illustrated in the graph of FIG. 20, the optimum bias correction amount in the pressure setting 2 to 4 differs between the time of sheet transfer and time of belt transfer. Accordingly, the control unit 200 preferably changes the adjustment amount of the DC component of the secondary transfer bias at the time of sheet transfer in which the toner on the intermediate transfer belt 31 is transferred to the recording sheet P and at the time of belt transfer in which the toner on the intermediate transfer belt 31 is transferred to the sheet conveying belt 41.

FIG. 21 is a table illustrating an example of a bias correction amount in each of the pressure settings 1 to 4 at the time of sheet transfer and the time of belt transfer according to the present embodiment.

As described above, by using the bias correction amount that differs between the time of sheet transfer and the time of the belt transfer, when the test image is transferred between the sheets, the transfer can be performed with the optimum secondary transfer current when performing the continuous image forming operation under any of the pressure settings 1 to 4, so that appropriate image quality adjustment is possible.

The above description is an example and has a specific effect for each of the following aspects.

[First Aspect]

The first aspect is an image forming apparatus including an image bearer (for example, the intermediate transfer belt 31); a nip forming member (for example, the sheet conveying belt 41) configured to form a transfer nip (for example, the secondary transfer nip N) between the image bearer and the nip forming member; a nip pressure changer (for example, the nip pressure changing device 60) configured to change a nip pressure of the transfer nip; a transfer bias applier (for example, the secondary transfer power supply 39) configured to apply, to the transfer nip, a transfer bias (for example, the secondary transfer bias) in which an AC component is superimposed on a DC component; and a DC component adjuster (for example, the control unit 200) configured to adjust the DC component in the transfer bias, according to the nip pressure that is changed by the nip pressure changer.

The transfer bias in which the AC component is superimposed on the DC component is often used to transfer the toner on the image bearer to a recording sheet (low smoothness sheet) having a low smoothness, such as an irregular sheet. At this time, as the nip pressure of the transfer nip is increased, the toner transfer rate (particularly the toner transfer rate to the recessed portion of the sheet surface) to the low smoothness sheet is improved, and thus good transfer performance can be obtained.

This is because, by increasing the transfer nip pressure, the surface shape of the image bearer follows the surface irregularities of the low smoothness sheet and deforms, thereby increasing the adhesiveness between the image bearer and the low smoothness sheet. As a result, a high toner transfer rate can be achieved even at the recessed portion.

However, it has been found that when the nip pressure of the transfer nip is changed, it is difficult to obtain good transfer performance in both a solid image and a halftone image if the conditions of the transfer bias remain constant. Specifically, if a transfer bias condition in which good transfer performance is obtained in both the solid image and the halftone image is set at a certain transfer nip pressure, and then the transfer nip pressure is raised with the transfer bias condition unchanged, the transfer performance of the halftone image is degraded even if the transfer performance of the solid image is improved.

Regarding the reasons why this problem arises, the inventors of the present invention have found the following, as a result of the study. That is, if the transfer nip pressure is raised without changing the transfer bias condition in which good transfer performance is obtained in both the solid image and the halftone image at a certain transfer nip pressure, the toner transfer rate of the solid image is increased by the improvement in the adhesion property. In this case, the halftone image is also subjected to the effect of increase in the toner transfer rate by the improvement in the adhesion. However, due to the increase in the transfer rate, the transfer current in the halftone image becomes excessive under the transfer bias condition applied up to this point. As a result, reverse charging or reverse transfer of the toner is caused in the halftone image, and the toner transfer rate is actually degraded.

Note that, although the image forming apparatus disclosed in Patent Document 1 performs control for changing the transfer nip pressure in accordance with a change in the duty ratio of the transfer bias, the duty ratio is not changed from the viewpoint of solving the above-described problem.

According to the present embodiment, when the transfer nip pressure is changed by the nip pressure changing means, the DC component of the transfer bias can be adjusted in accordance with the transfer nip pressure by the DC component adjusting means. Therefore, for example, when the transfer nip pressure is increased in order to improve the toner transfer rate of the solid image, it is possible to reduce the DC component of the transfer bias in accordance with the raised transfer nip pressure, thereby reducing the transfer current and reducing the excess in the transfer current with respect to the halftone image. At this time, by lowering the DC component of the transfer bias, the toner transfer rate of the solid image may be affected. However, the amount of adjusting the DC component of the transfer bias within the range of reducing the excess in the transfer current with respect to the halftone image, does not have an effect of cancelling out the effect of increasing the toner transfer rate of the solid image by increasing the transfer nip pressure. Accordingly, according to the present embodiment, a high transfer rate can be obtained in both the solid image and the halftone image, and good transfer performance can be obtained.

[Second Aspect]

The second aspect according to the first aspect further includes a duty ratio changer (for example, the control unit 200) configured to change a duty ratio of the transfer bias, the duty ratio being represented by $(T-Tt)/T\times100$ [%], where T represents a cycle of the transfer bias and Tt represents a time (for example, the transfer-side time) when the transfer bias is on a transfer side, causing toner to move from the image bearer to the nip forming member, relative to a time average value Vave of the transfer bias, within the cycle T, wherein an adjustment amount (for example, the bias correction amount) of the DC component adjusted by the DC component adjuster differs according to a difference in the duty ratio changed by the duty ratio changer.

According to this, even if the duty ratio of the transfer bias is changed, a high transfer rate can be achieved in both the solid image and the halftone image, and good transfer performance can be obtained.

[Third Aspect]

In a third aspect according to the second aspect, the adjustment amount of the DC component adjusted by the DC component adjuster differs between a time when the duty ratio is greater than or equal to 50% and a time when the duty ratio is less than 50%.

According to this, even if the duty ratio of the transfer bias is changed, a high transfer rate can be achieved in both the solid image and the halftone image, and good transfer performance can be obtained.

[Fourth Aspect]

In the fourth aspect according to any one of the first to third aspects, an adjustment amount of the DC component adjusted by the DC component adjuster differs between a time when toner on the image bearer is transferred to a recording sheet (for example, the time of sheet transfer) and a time when the toner on the image bearer is transferred to the nip forming member (for example, the time of belt transfer).

According to this, when the toner on the image bearer is transferred to the recording sheet, or when the toner on the image bearer is transferred to the nip forming member, a high transfer rate can be achieved in both the solid image and the halftone image, and good transfer performance can be obtained.

[Fifth Aspect]

In the fifth aspect according to any one of the first to fourth aspects, an adjustment amount of the DC component adjusted by the DC component adjuster differs according to a difference in a type of a recording sheet (smoothness, basis weight, sheet thickness, brand, etc.) to which toner on the image bearer is transferred.

According to this, even if the type of recording sheet (smoothness, basis weight, sheet thickness, brand, etc.) is changed, a high transfer rate can be achieved in both the solid image and the halftone image, and good transfer performance can be obtained.

[Sixth Aspect]

The sixth aspect according to the fifth aspect further includes an input receiver (for example, the input operation unit 501) configured to receive input of information relating to the type of the recording sheet, wherein the DC component adjuster identifies the difference in the type of the recording sheet based on the information received by the input receiver.

According to this, it is possible to identify the type of the recording sheet with a simple configuration.

[Seventh Aspect]

A seventh aspect according to any one of the first to sixth aspects includes an environment information acquirer (for example, the temperature and humidity sensor) configured to acquire operation environment information (for example, information of the temperature and humidity environment) of the image forming apparatus, wherein an adjustment amount of the DC component adjusted by the DC component adjuster differs according to a difference in the operation environment information acquired by the environment information acquirer.

According to this, even when the operation environment of the image forming apparatus is changed, a high transfer rate can be achieved in both the solid image and the halftone image, and good transfer performance can be obtained.

[Eighth Aspect]

In an eighth aspect according to any one of the first to seventh aspects, the image bearer has a multiple layer structure in which a base layer 31*a* and an elastic layer 31*b* having more elasticity than the base layer are stacked on each other.

Therefore, it is possible to obtain good transfer performance even with a recording sheet having a low surface smoothness, such as an irregular sheet.

According to one embodiment of the present invention, even when the nip pressure of the transfer nip is changed, good transfer performance can be obtained in both the solid image and the halftone image.

The image forming apparatus is not limited to the specific embodiments described in the detailed description, and variations and modifications may be made without departing from the spirit and scope of the present invention.

What is claimed is:

1. An image forming apparatus comprising:

an image bearer;

a nip forming member configured to form a transfer nip between the image bearer and the nip forming member, wherein the nip forming member is configured to convey a recording sheet through the transfer nip;

a nip pressure changer configured to change a nip pressure of the transfer nip;

a transfer bias applier configured to apply, to the transfer nip, a transfer bias in which an AC component is superimposed on a DC component; and a DC component adjuster configured to adjust the DC component in the transfer bias, according to the nip pressure that is changed by the nip pressure changer, wherein, the DC component adjuster is further configured to maintain the DC component in the transfer bias unchanged after adjustment for an entire period during which the recording sheet is conveyed through the transfer nip.

2. The image forming apparatus according to claim 1, further comprising:

a duty ratio changer configured to change a duty ratio of the transfer bias, the duty ratio being represented by $$(T-Tt)/T\times100[\%],$$

where T represents a cycle of the transfer bias and Tt represents a time when the transfer bias is on a transfer side, causing toner to move from the image bearer to the nip forming member, relative to a time average value of the transfer bias, within the cycle T, wherein an adjustment amount of the DC component adjusted by the DC component adjuster differs according to a difference in the duty ratio changed by the duty ratio changer.

3. The image forming apparatus according to claim 2, wherein the adjustment amount of the DC component adjusted by the DC component adjuster differs between a time when the duty ratio is greater than or equal to 50% and a time when the duty ratio is less than 50%.

4. The image forming apparatus according to claim 1, wherein an adjustment amount of the DC component adjusted by the DC component adjuster differs between a time when toner on the image bearer is transferred to the recording sheet and a time when the toner on the image bearer is transferred to the nip forming member.

5. The image forming apparatus according to claim 1, wherein an adjustment amount of the DC component adjusted by the DC component adjuster differs according to a difference in a type of the recording sheet to which toner on the image bearer is transferred.

6. The image forming apparatus according to claim 5, further comprising:

an input receiver configured to receive input of information relating to the type of the recording sheet, wherein the DC component adjuster identifies the difference in the type of the recording sheet based on the information received by the input receiver.

7. The image forming apparatus according to claim 1, further comprising:

an environment information acquirer configured to acquire operation environment information of the image forming apparatus, wherein an adjustment amount of the DC component adjusted by the DC component adjuster differs according to a difference in the operation environment information acquired by the environment information acquirer.

8. The image forming apparatus according to claim 1, wherein the image bearer has a multiple layer structure in which a base layer and an elastic layer having more elasticity than the base layer are stacked on each other.

9. The image forming apparatus according to claim 1, further comprising:

a control unit;

a user input device, coupled with the control unit, configured to receive input from a user selecting a desired nip pressure, wherein the control unit is further configured to receive user input from the user input device indicating a desired nip pressure, and wherein the control unit is further configured to controllably change the nip pressure to the desired nip pressure by controlling the nip pressure changer.

10. The image forming apparatus according to claim 9, wherein the user input device is configured to receive user input indicating a selection of one of a plurality of predetermined desired nip pressure values, and wherein the control unit is further configured to controllably change the nip pressure to a predetermined desired nip pressure value associated with the user input selection by controlling the nip pressure changer.

11. An image forming apparatus comprising:

an image bearer;

a nip forming member configured to form a transfer nip between the image bearer and the nip forming member;

a control unit;

a nip pressure changer configured to change a nip pressure of the transfer nip, wherein the control unit is configured to controllably change the nip pressure at the transfer nip by controlling the nip pressure changer;

a transfer bias applier configured to apply, to the transfer nip, a transfer bias in which an AC component is superimposed on a DC component; and a DC component adjuster configured to adjust the DC component in the transfer bias, according to the nip pressure that is changed by the nip pressure changer.

12. The image forming apparatus according to claim 11, further comprising:

a duty ratio changer configured to change a duty ratio of the transfer bias, the duty ratio being represented by $$(T-Tt)/T\times100[\%],$$

where T represents a cycle of the transfer bias and Tt represents a time when the transfer bias is on a transfer side, causing toner to move from the image bearer to the nip forming member, relative to a time average value of the transfer bias, within the cycle T, wherein an adjustment amount of the DC component adjusted by the DC component adjuster differs according to a difference in the duty ratio changed by the duty ratio changer.

13. The image forming apparatus according to claim 12, wherein the adjustment amount of the DC component adjusted by the DC component adjuster differs between a time when the duty ratio is greater than or equal to 50% and a time when the duty ratio is less than 50%.

14. The image forming apparatus according to claim 11, wherein an adjustment amount of the DC component adjusted by the DC component adjuster differs between a time when toner on the image bearer is transferred to a recording sheet and a time when the toner on the image bearer is transferred to the nip forming member.

15. The image forming apparatus according to claim 11, wherein an adjustment amount of the DC component adjusted by the DC component adjuster differs according to a difference in a type of a recording sheet to which toner on the image bearer is transferred.

16. The image forming apparatus according to claim 15, further comprising:

an input receiver configured to receive input of information relating to the type of the recording sheet, wherein the DC component adjuster identifies the difference in the type of the recording sheet based on the information received by the input receiver.

17. The image forming apparatus according to claim 11, further comprising:

an environment information acquirer configured to acquire operation environment information of the image forming apparatus, wherein an adjustment amount of the DC component adjusted by the DC component adjuster differs according to a difference in the operation environment information acquired by the environment information acquirer.

18. The image forming apparatus according to claim 11, wherein the image bearer has a multiple layer structure in which a base layer and an elastic layer having more elasticity than the base layer are stacked on each other.

19. The image forming apparatus according to claim 11, further comprising:

a user input device, coupled with the control unit, the user input device configured to receive input from a user selecting a desired nip pressure, wherein the control unit is further configured to receive user input from the user input device indicating a desired nip pressure, and wherein the control unit is further configured to controllably change the nip pressure to the desired nip pressure by controlling the nip pressure changer.

20. The image forming apparatus according to claim 19, wherein the user input device is configured to receive user input indicating a selection of one of a plurality of predetermined desired nip pressure values, and wherein the control unit is further configured to controllably change the nip pressure to a predetermined desired nip pressure value associated with the user input selection by controlling the nip pressure changer.

* * * * *